US012516900B2

(12) United States Patent
Roberts

(10) Patent No.: US 12,516,900 B2
(45) Date of Patent: Jan. 6, 2026

(54) FEED TOWER MOUNTED LEAF SPRINGS FOR MAGAZINES

(71) Applicant: Magpul Industries Corp., Austin, TX (US)

(72) Inventor: Timothy Eric Roberts, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 18/575,448

(22) PCT Filed: Jul. 5, 2022

(86) PCT No.: PCT/US2022/036116

§ 371 (c)(1),
(2) Date: Dec. 29, 2023

(87) PCT Pub. No.: WO2023/278892

PCT Pub. Date: Jan. 5, 2023

(65) Prior Publication Data

US 2024/0210135 A1 Jun. 27, 2024

Related U.S. Application Data

(60) Provisional application No. 63/218,085, filed on Jul. 2, 2021.

(51) Int. Cl.
*F41A 9/75* (2006.01)
*F41A 9/70* (2006.01)

(52) U.S. Cl.
CPC . *F41A 9/70* (2013.01); *F41A 9/75* (2013.01)

(58) Field of Classification Search
CPC ..... F41A 9/73; F41A 9/74; F41A 9/75; F41A 9/61; F41A 9/65; F41A 9/69; F41A 9/71
See application file for complete search history.

(56) References Cited

U.S. PATENT DOCUMENTS

| | | | | |
|---|---|---|---|---|
| 3,039,221 | A | 6/1962 | Musgrave | |
| 3,509,654 | A | 5/1970 | Ludwig | |
| 4,926,742 | A * | 5/1990 | Ma | F41A 9/75 89/33.02 |
| 2012/0117840 | A1* | 5/2012 | Chewning | F41A 9/70 42/49.01 |

(Continued)

OTHER PUBLICATIONS

European Patent Application No. 22834348.9, Extended European Search Report dated Sep. 30, 2024. 8 pages.

(Continued)

*Primary Examiner* — Jonathan C Weber
(74) *Attorney, Agent, or Firm* — NOD Law PC

(57) ABSTRACT

Leaf springs for use in a firearm magazine are described. The leaf springs comprising an inner edge, an outer edge, and a channel, and configured to facilitate movement of cartridges within a feed tower of the firearm magazine. The leaf springs can be in a flexed or unflexed position, wherein downward movement of the cartridges in the feed tower outwardly flex the leaf springs into the flexed position to facilitate downward translation of the cartridges by forcing the inner edge of the leaf springs away from the cartridges, and in the unflexed position, the inner edge of the leaf springs is parallel or substantially parallel to an edge of the cartridges in the feed tower.

30 Claims, 24 Drawing Sheets

(56) References Cited

U.S. PATENT DOCUMENTS

| | | | | |
|---|---|---|---|---|
| 2014/0076137 | A1* | 3/2014 | Lasichak | F41A 9/70<br>89/33.02 |
| 2015/0176936 | A1* | 6/2015 | Wei | F41A 9/75<br>42/49.01 |
| 2016/0102931 | A1* | 4/2016 | Roberts | F41A 9/70<br>89/33.02 |
| 2019/0086172 | A1* | 3/2019 | Roberts | F41A 9/75 |
| 2020/0386497 | A1* | 12/2020 | Corso | F41A 9/65 |

OTHER PUBLICATIONS

International PCT patent application No. PCT/US2022/036116, filed Jul. 5, 2022. International Preliminary Report on Patentability dated Oct. 18, 2023. 12 pages.

International PCT patent application No. PCT/US2022/036116, filed Jul. 5, 2022. International Search Report dated Nov. 16, 2022. 4 pages.

International PCT patent application No. PCT/US2022/036116, filed Jul. 5, 2022. Written Opinion of the International Searching Authority dated Nov. 16, 2022. 6 pages.

* cited by examiner

FEED TOWER MOUNTED LEAF SPRINGS FOR MAGAZINES

CROSS-REFERENCE TO RELATED APPLICATIONS

This application is the United States National Phase of international PCT Patent Application No. PCT/US2022/036116, filed Jul. 5, 2022, entitled "FEED TOWER MOUNTED LEAF SPRINGS FOR MAGAZINES," which claims priority to and the benefit of U.S. Provisional Application No. 63/218,085, filed Jul. 2, 2021, entitled "FEED TOWER MOUNTED LEAF SPRINGS FOR MAGAZINES," the entire disclosure of all aforementioned applications are hereby incorporated by reference for all proper purposes.

FIELD OF THE DISCLOSURE

The present disclosure relates generally to firearms. In particular, but not by way of limitation, the present disclosure relates to feed tower mounted leaf springs for firearm magazines.

BACKGROUND OF THE DISCLOSURE

Currently, many firearm ammunition magazines utilize some type of follower assembly, typically along with a spring-based pushing mechanism, to feed ammunition from the magazine into a firearm. The follower assembly is generally situated below an ammunition cartridge/round stack and is configured to push the cartridges along a path that exits the magazine through an open end of the magazine, often called the "feed end," which interfaces with a firearm. Specifically, in drum magazines, the feed end may be situated at the top of a feed tower, the feed tower attaching to a drum body that typically stores cartridges along a winding track with an overall spiral shape.

In some instances, drum magazines are specifically designed to interface with handguns (e.g., the SGM Tactical Glock 9 mm 50 Round Drum Magazine and the RWB Glock 9 mm 50 Round Drum Magazine) or carbines using pistol-type cartridges (e.g., H&K UMP45, Kel-Tec SUB-2000, Rock River Arms LAR-9 CAR A4). Such firearms may also include a slide mechanism, most commonly seen in semi-automatic handguns, which may be configured to interface with a bolt or slide lock-back mechanism, sometimes called a slide stop. Slide lock-back mechanisms may be engaged when a magazine has expended all of its cartridges providing a visual indicator that the magazine is empty as well as assisting in the reloading process.

Some firearms, such as the GLOCK, include a ramped underlug feature on the slide. In some cases, this underlug may be located directly above the round or cartridge and may act on the magazine round stack when the weapon is cycled, forcing the cartridges back down into the magazine. In order for this to occur, the round stack in the magazine must be able to move away from the chamber, or down into the magazine (or against the spring pre-load). In some circumstances, the force needed to overcome the primary spring pressure (i.e., generated by the spring-based pushing mechanism, for instance, a torsional spring in a drum magazine body) may be greater than the downward force produced by the weapon system (i.e., after the weapon is fired and the action is cycled). Hence, drum magazines, and other styled magazines with significant primary spring pressure can be incompatible with or problematic when used with firearms having an underlug on the slide.

SUMMARY

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some aspects of the disclosure may be characterized as a firearm magazine, comprising a body and a feed tower. The feed tower may be configured to house one or more cartridges and may comprises a feed end, a base end, and one or more leaf springs. The one or more leaf springs may be positioned within the feed tower and may be configured to bias the one or more cartridges through the feed tower either towards the feed end or base end of the feed tower. The body may be coupled to the base end of the feed tower and may be configured to receive the one or more cartridges.

Other aspects of the disclosure may be characterized as a leaf spring system. The system may comprise one or more leaf springs which may comprise an inner edge, an outer edge, and a channel. The inner edge may comprise a ramped surface. The channel may be formed on the outer edge by vertical sections and may be shaped and sized to be secured over a rail in an interior of a feed tower. One or more of the vertical sections and the outer edge may be in contact with an interior surface of the feed tower; and a curved section may be positioned between the inner edge and the outer edge and form a C-shaped curve in the one or more leaf springs.

DETAILED DESCRIPTION OF THE DRAWINGS

Figure 1:
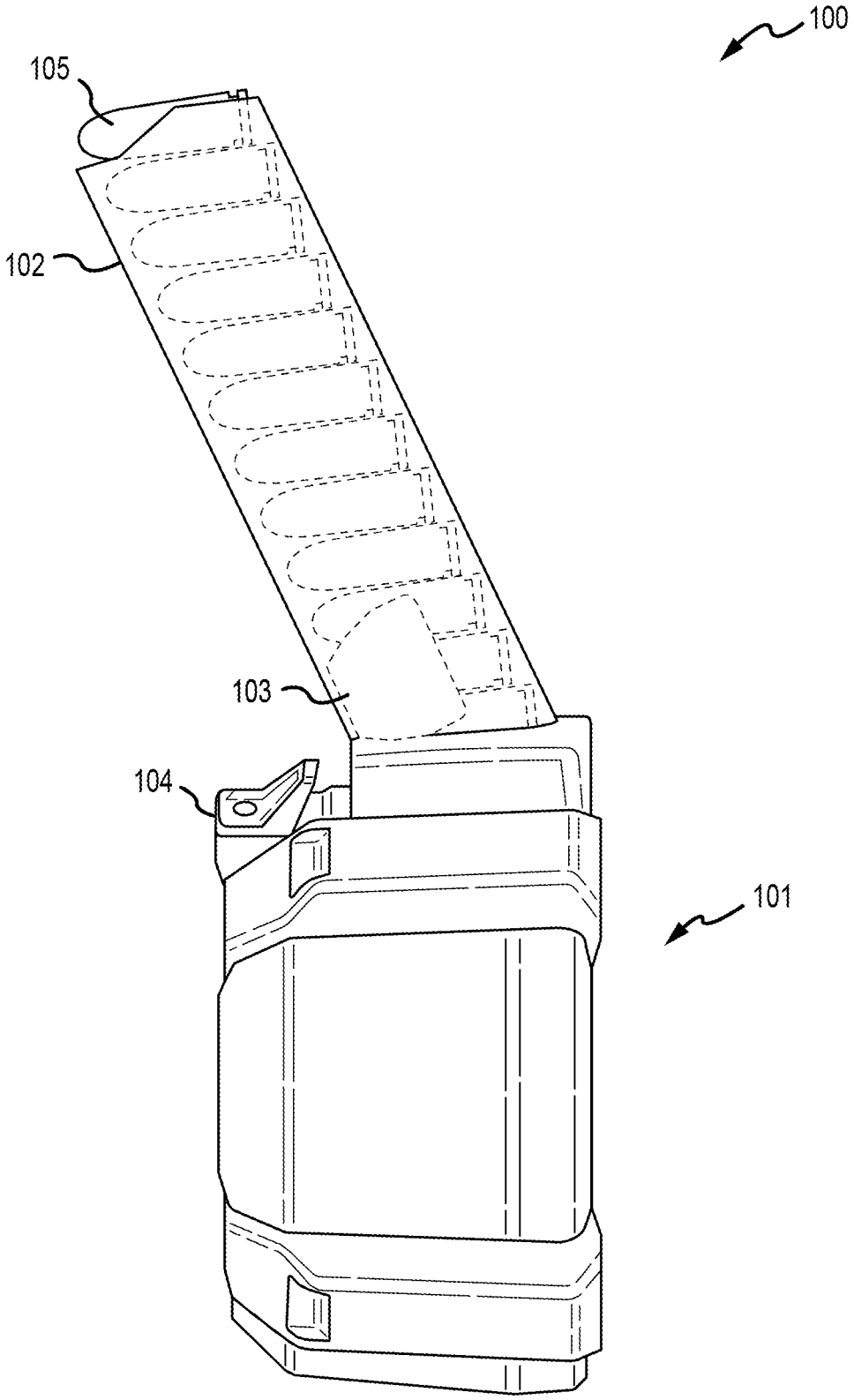
FIG. 1 illustrates a firearm magazine with one or more leaf springs of an embodiment of the present disclosure.

The word "exemplary" is used herein to mean "serving as an example, instance, or illustration." Any embodiment described herein as "exemplary" is not necessarily to be construed as preferred or advantageous over other embodiments. Furthermore, for the purpose of this disclosure, the terms "front" and "distal" shall refer to a side or direction associated with a direction of intended fire; for example, in FIG. 1, the front or distal side is towards the left. When referencing pivoting or rotating components, the term "distal" shall refer to a section of the component that is distant from the pivot point, while the term "proximal" shall refer to a section of the component approaching the pivot point. Similarly, the terms "back", "rear", or "proximal" shall be associated with the intended bracing of a weapon, or the intended pivot point of a pivoting or rotating component. Moreover, for the purpose of this document, the term "cartridge" should be understood to include generally ammunition that can be magazine-fed, such as, for example, shotgun cartridges, grenade cartridges, and any other ammunition packaging a bullet or shot, a propellant substance and a primer within a case that is made to fit within a firing chamber of a firearm. Furthermore, for the purpose of this disclosure, the terms "spiral" and "generally spiraled" are meant to include any feature generally winding about a fixed point at a continuously and/or discontinuously increasing distance.

There is currently a need for a mechanism for a feed tower assembly that can facilitate the downward translation of the round stack in a magazine, such as a drum magazine, when a feed end of the magazine interfaces with a ramped underlug of the firearm. As described above, some firearm magazines comprise follower assemblies that can interface with a slide lock-back mechanism to lock the slide in a slide-backward position when the magazine no longer contains any ammunition cartridges. According to aspects of the present disclosure, the herein disclosed feed tower assembly mechanism may be capable of permitting any of closed-bolt (or slide-forward) or open-bolt (or slide-backward) magazine insertion into the weapon. In other words, a magazine can be inserted into a firearm with an underlug-allowing some rounds in the stack to be pushed downward by the underlug even when the primary magazine spring pressure exceeds the pressure from the underlug. This is made possible by one or more leaf springs arranged toward a base end of the feed tower that can flex outward to widen the round stack in the vicinity of the one or more leaf springs and thereby allow the round stack in the feed tower to compress even if this force is insufficient to compress or wind the primary magazine spring. In other words, the leaf springs currently disclosed allow the round stack to be pushed downward in the tower without imparting much if any force on rounds in a drum. In one non-limiting example, a pair of leaf springs nested opposite each other on the right and left side of the round stack (arranged on opposing long edges of the cartridges) may be provided. It should be noted that, other mechanisms, besides leaf springs, are contemplated in different embodiments. Further, more or less than two leaf springs may be utilized in some embodiments.

Figure 2:
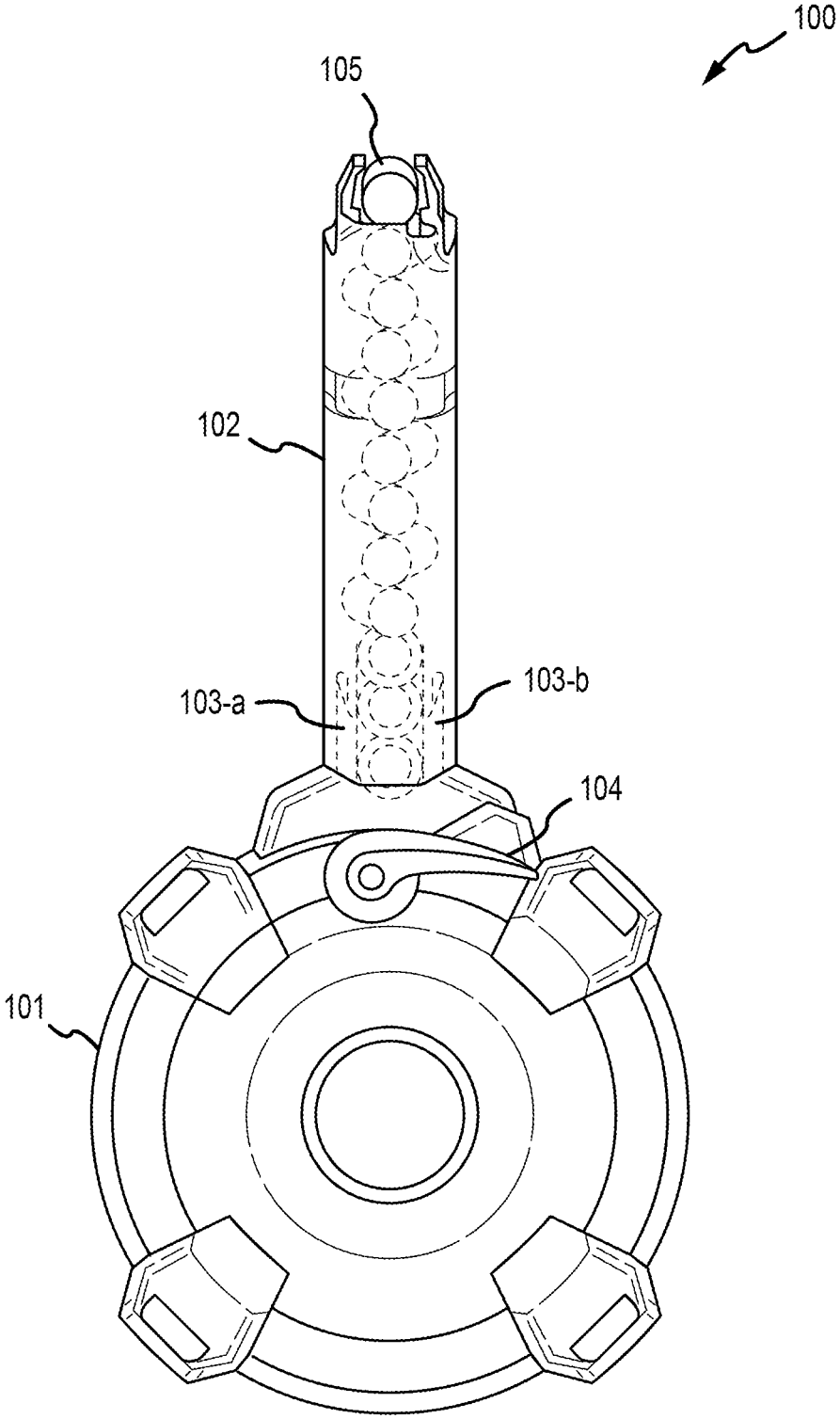
FIG. 2 illustrates two exemplary leaf springs nested opposite each other in a feed tower of an embodiment of the present disclosure.
Figure 3:
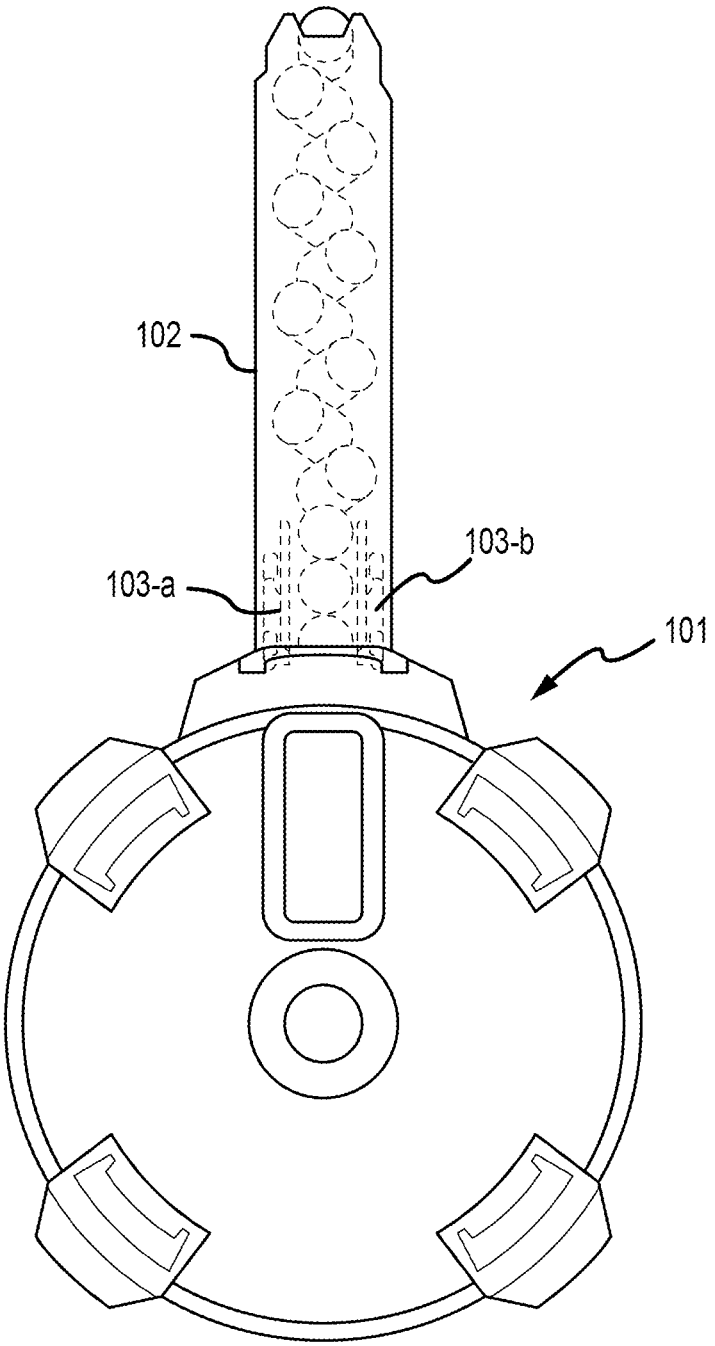
FIG. 3 illustrates a rear view of a firearm magazine of an embodiment of the present disclosure.
Figure 4:
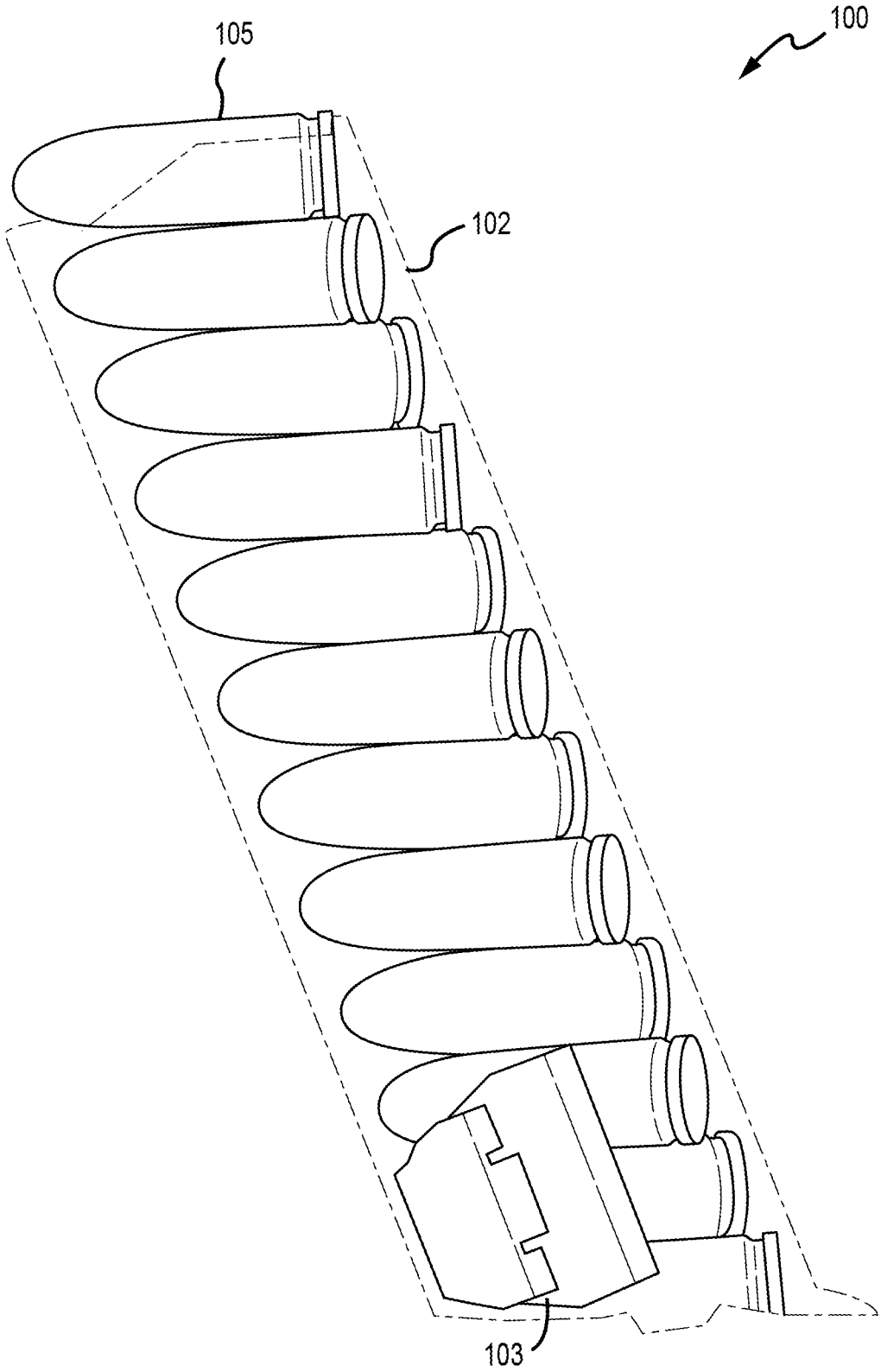
FIG. 4 illustrates a close-up view of a feed tower showing one or more leaf springs at a base end of the feed tower of an embodiment of the present disclosure.

FIG. 1 illustrates an example of a drum magazine 100 with a feed tower 102, a drum body 101, a lever 104, and one or more leaf springs 103 at or near the base of the feed tower 102. The drum magazine 100 may be configured to hold a plurality of cartridges 105. For instance, the drum magazine 100 may be configured to hold 50 to 100 or more cartridges, such as in a single-stack design having a generally spiraled stack configuration inside the drum body 101. While not shown, in some cases, the drum body 101 may comprise a torsional spring configured to bias the cartridges in the drum magazine through the feed tower 102 and towards the feed end of the magazine. FIG. 2 shows more clearly the leaf springs 103-*a* and 103-*b*, where the leaf springs 103 are nested opposite each other on the right and left side of the long edges of cartridges 105 in the feed tower 102. It should be noted that, FIG. 2 depicts the leaf springs 103-*a* and 103-*b* in an unflexed position. In this position, the inner edges of the leaf spring may be parallel or substantially parallel an edge of the round stack between the one or more leaf springs or parallel or substantially parallel to a plane passing through the round stack, and may or may not be in contact with the cartridges (e.g., the leaf springs and cartridge edges may be separated by a small gap). The space between the leaf springs 103-*a* and 103-*b* can be such that the round stack between them is considered "single stack" while being double stack or single stack angled between the leaf springs 103-*a* and 103-*b* and the feed end. FIG. 3 illustrates a rear view of the drum magazine 100. Further, FIG. 4 illustrates a close-up view of the feed tower 102, showing the leaf springs 103 at the base of the feed tower. Again, one sees that the leaf springs 103-*a* and 103-*b* force the cartridges into a common alignment while between the leaf springs 103-*a* and 103-*b* and that the cartridges are alternately angled relative to each other through a remainder of the round stack.

While FIGS. 1-4 illustrate one embodiment of leaf springs that allow the round stack to be pushed downward in the tower without imparting much if any force on rounds in a drum, other leaf springs variants can also be implemented. Some non-limiting examples are shown in FIGS. 8-18.

Figure 8A:
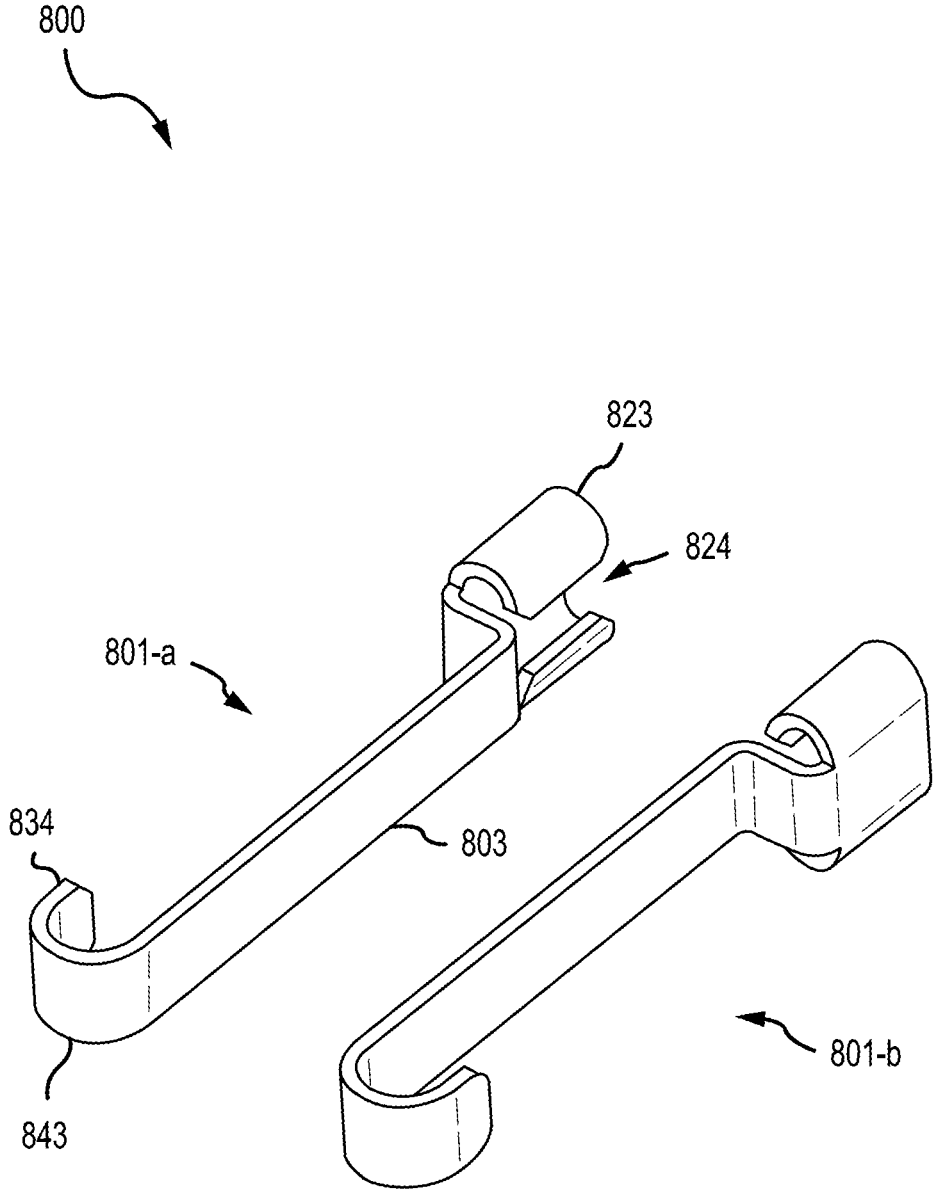
FIG. 8A illustrates one or more leaf springs of an alternative embodiment of the present disclosure.
Figure 8B:
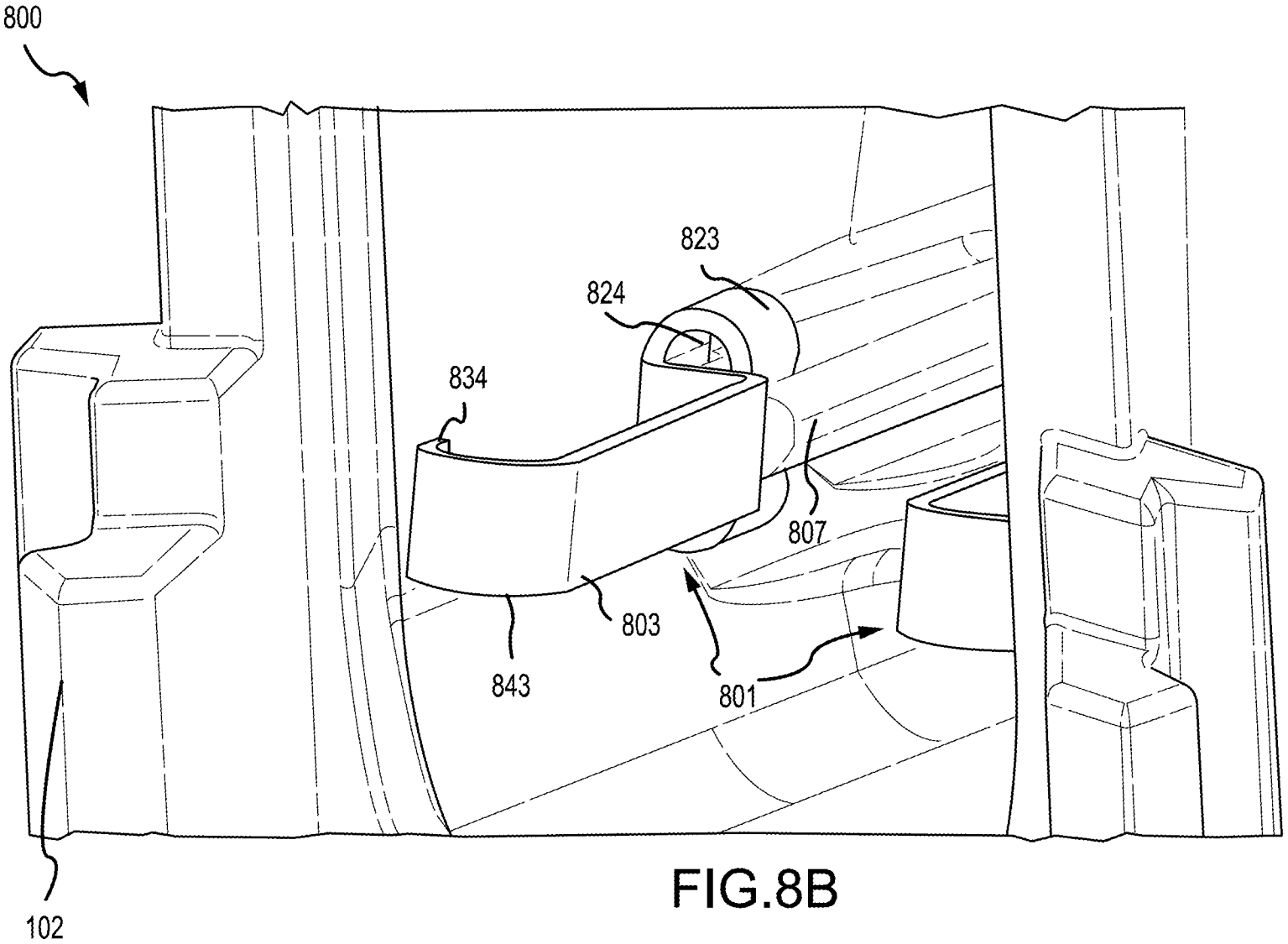
FIG. 8B illustrates one or more leaf springs of an alternative embodiment of the present disclosure.
Figure 8C:
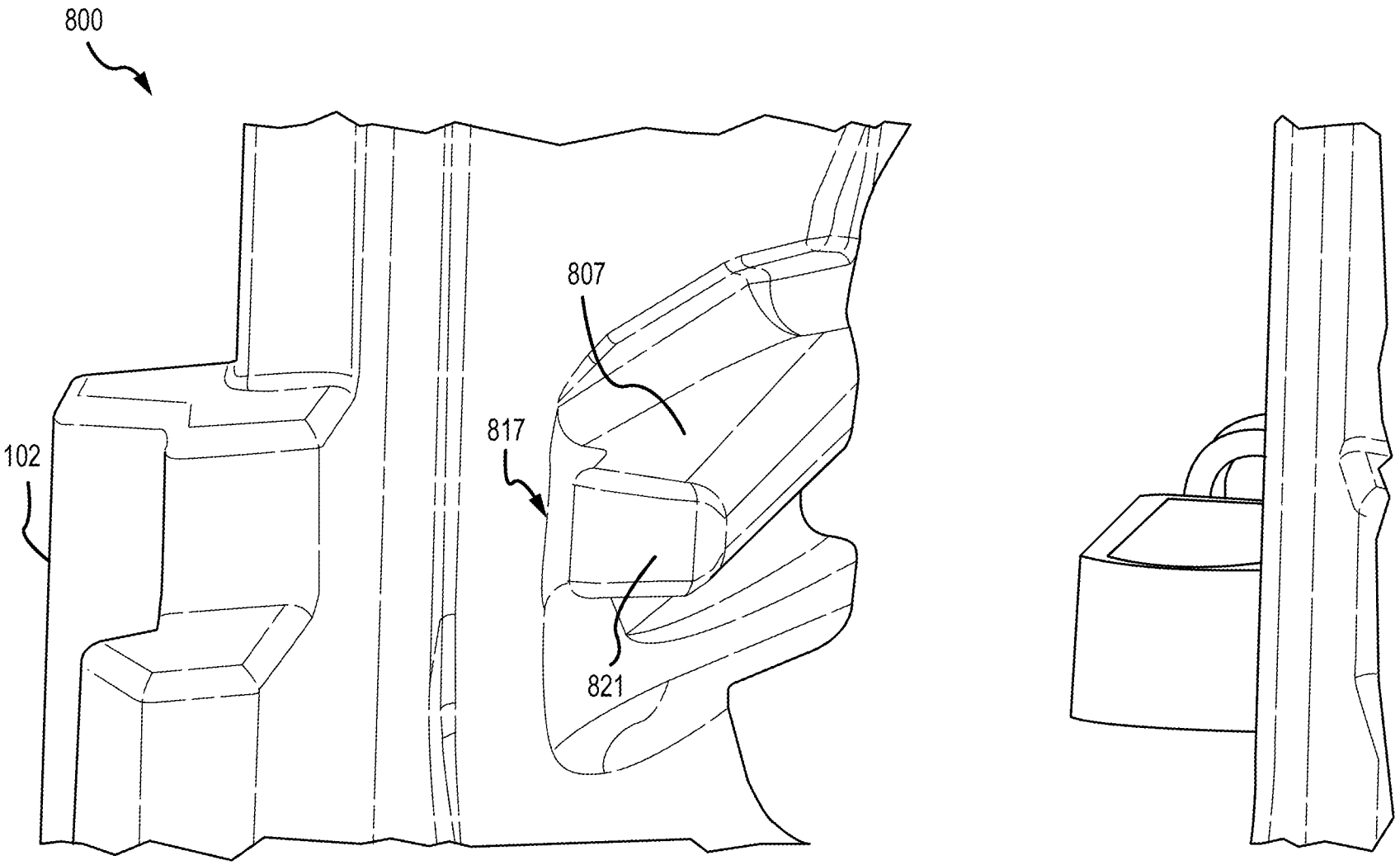
FIG. 8C illustrates one or more leaf springs of an alternative embodiment of the present disclosure.

FIGS. 8A-8C illustrate an example of a leaf spring system 800 comprising one or more leaf springs 801 (e.g., leaf springs 801-*a*, 801-*b*), according to an alternate embodiment of the present disclosure. The leaf springs 801 may implement one or more aspects of the leaf springs 103, or any other of the other leaf springs described throughout this disclosure. In some examples, each of the leaf springs 801 may comprise an inner edge 803, a hairpin section 843, and a clip 823 having an opening 824. In some cases, the hairpin section 843 may comprise a protrusion 834 that is configured to be parallel or substantially parallel to the inner edge 803 when the leaf spring 801 is an unflexed position. In some cases, the leaf spring system 800 may be configured to mount to an interior of the feed tower using the clip 823. In some cases, the leaf springs 801 may be composed of a material, such as metal (e.g., steel, stainless steel, steel alloy or another alloy, aluminum, etc.), a polymer (e.g., plastic), or any other applicable material. In some embodiments, the leaf spring system 800 may be locked into position within the magazine body (e.g., inside feed tower 102 in FIG. 1) when the magazine is assembled, as shown in FIGS. 8B and 8C. The leaf spring system 800 may or may not be removable after magazine assembly. In some cases, the leaf springs 801 may be mounted to an interior of the feed tower 102, as shown in FIG. 8C. FIG. 8B illustrates a pair of leaf springs 801 nested opposite each other in the interior of the feed tower 102. In some embodiments, the opening in the clip 823 may be shaped and sized to receive (or clamp over) a rail 807 in the interior of the feed tower 102. Further, the feed tower may comprise a gap 817 (shown in FIG. 8C) between the rail 807 and the body (or inner sidewall) of the feed tower. In some cases, at least a portion (e.g., an inner surface) of the channel 824 may be received within the gap 817, while another surface of the channel (e.g., a surface adjacent the inner edge 803) may be pushed against a front face 821 of the rail 807. In this way, the leaf spring 801 may be securely mounted to an interior of the feed tower 102. In some embodiments, the inner edge of the leaf spring 801 may be separated from the body of the feed tower by a gap, which may allow it flex outwards when the weapon is cycled, and the cartridge or round stack is pushed down into the magazine. In some embodiments, the leaf spring 801 may be configured to flex or bend between an unflexed and a flexed configuration, further described in relation to the figures below.

Figure 9:
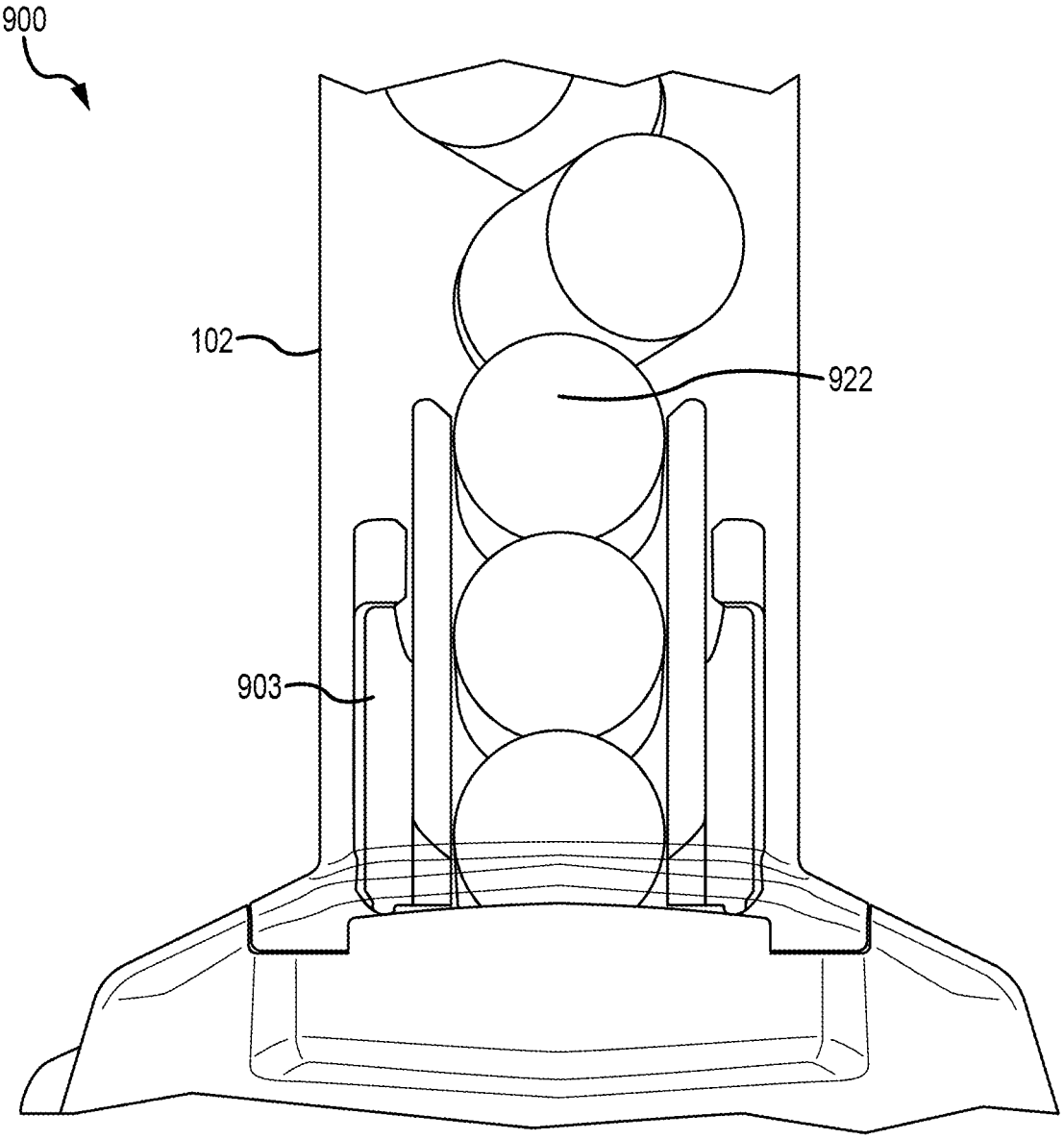
FIG. 9 illustrates one or more leaf springs of an alternative embodiment of the present disclosure.
Figure 10:
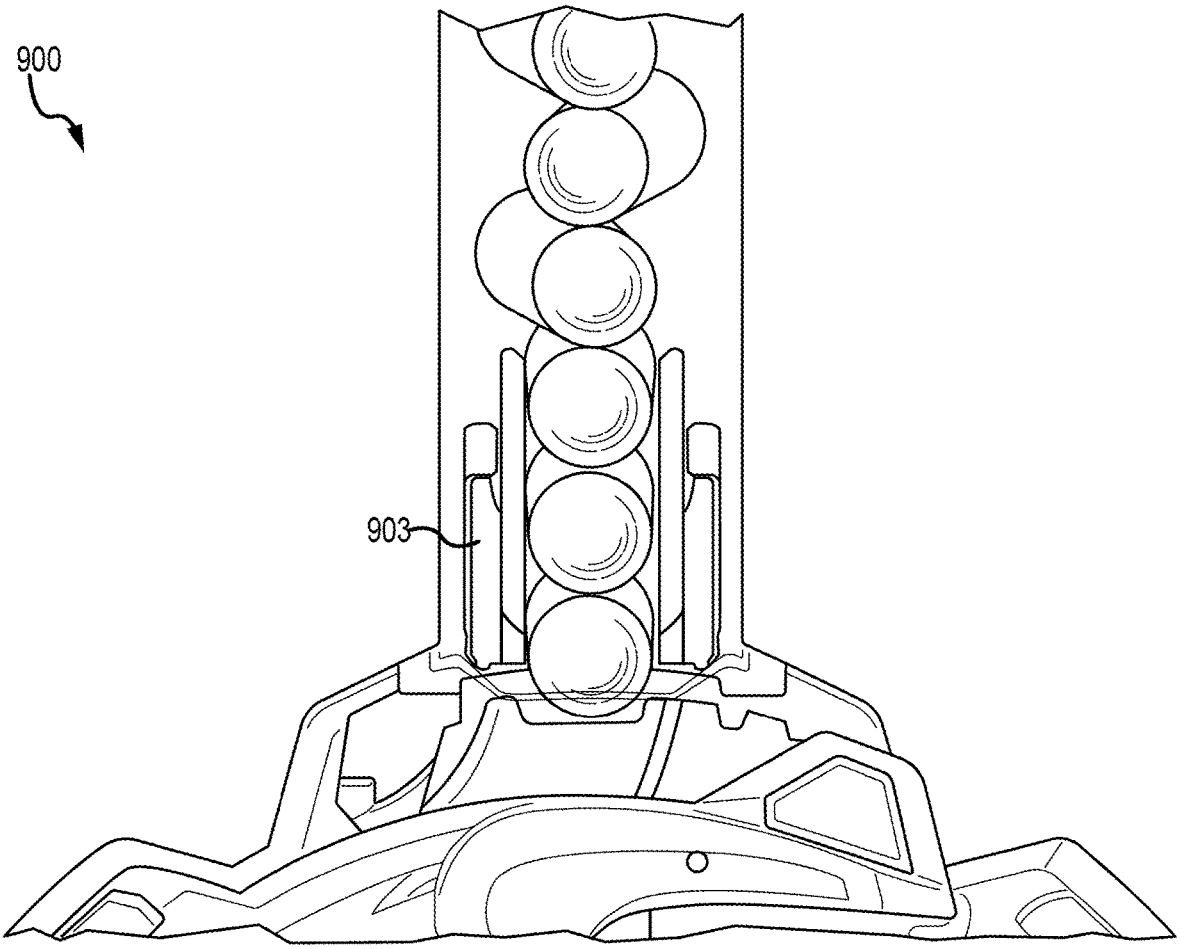
FIG. 10 illustrates a front view of one or more leaf springs of an embodiment of the present disclosure.

FIG. 9 illustrates an example of a leaf spring system 900 comprising one or more leaf springs 903, according to an embodiment of the present disclosure. In this example, the leaf springs 903 are in an unflexed position. As seen, when in an unflexed position, the leaf springs 903 are substantially parallel to a vertical axis 922 through the feed tower 102 and/or one or more rounds/cartridges in the feed tower. In some examples, the leaf springs 903 may not be in contact with the cartridges in the feed tower 102 when in an unflexed position. For instance, as shown, a small gap may be present between the leaf springs 903 and the cartridge edges. FIG. 10 illustrates a front view of the leaf spring system 900, previously described in relation to FIG. 9. In some embodiments, the leaf springs 903 may be substantially V-shaped or U-shaped (shown in further detail in FIG. 13). Further, the leaf springs 903 may be made of flat sheets of metal (e.g., steel, stainless steel, aluminum, an alloy, etc.), a polymer (e.g., plastic), or any other semi-rigid material.

Figure 11A:
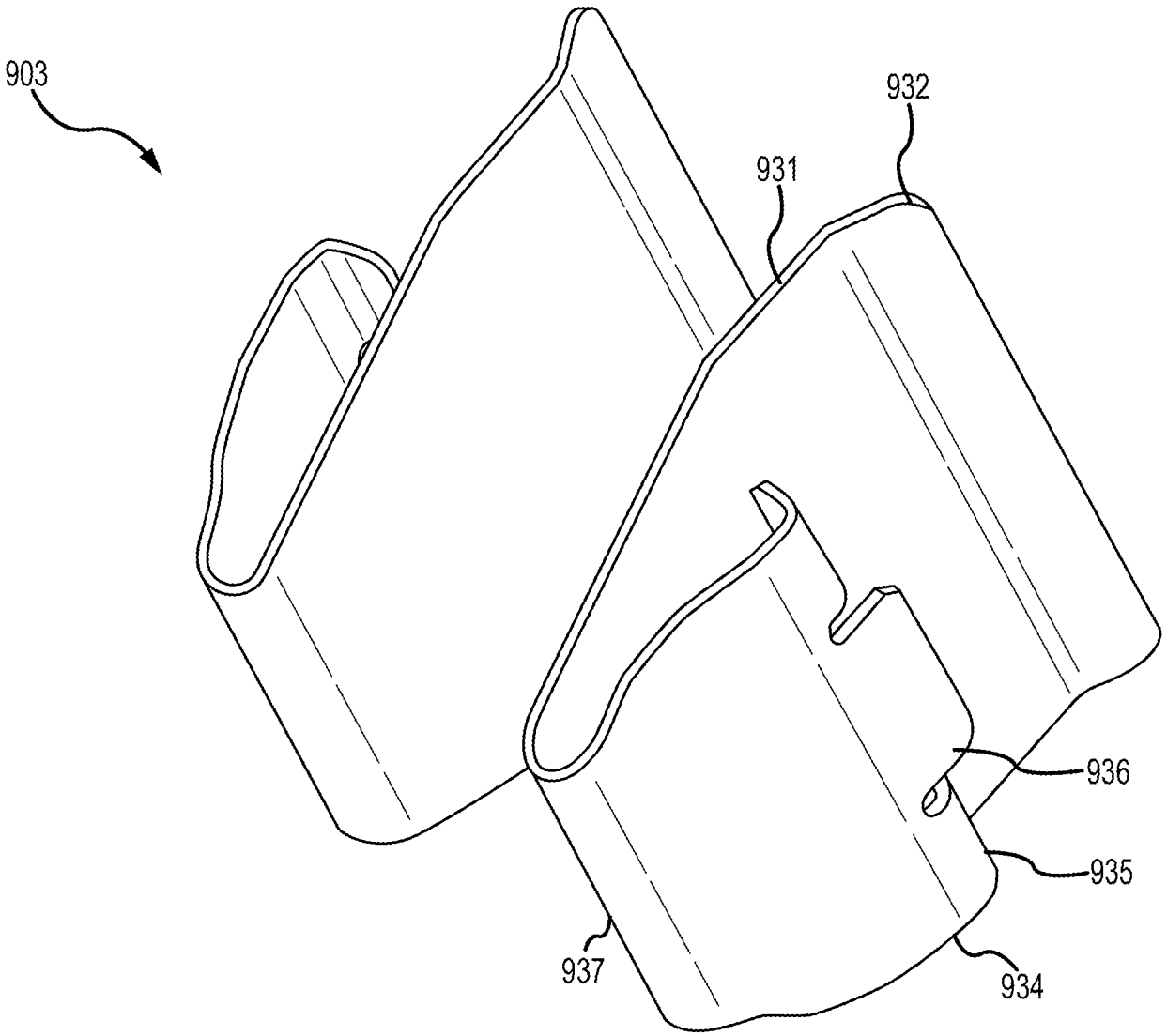
FIG. 11A illustrates a perspective view of one or more leaf springs of an embodiment of the present disclosure.
Figure 11B:
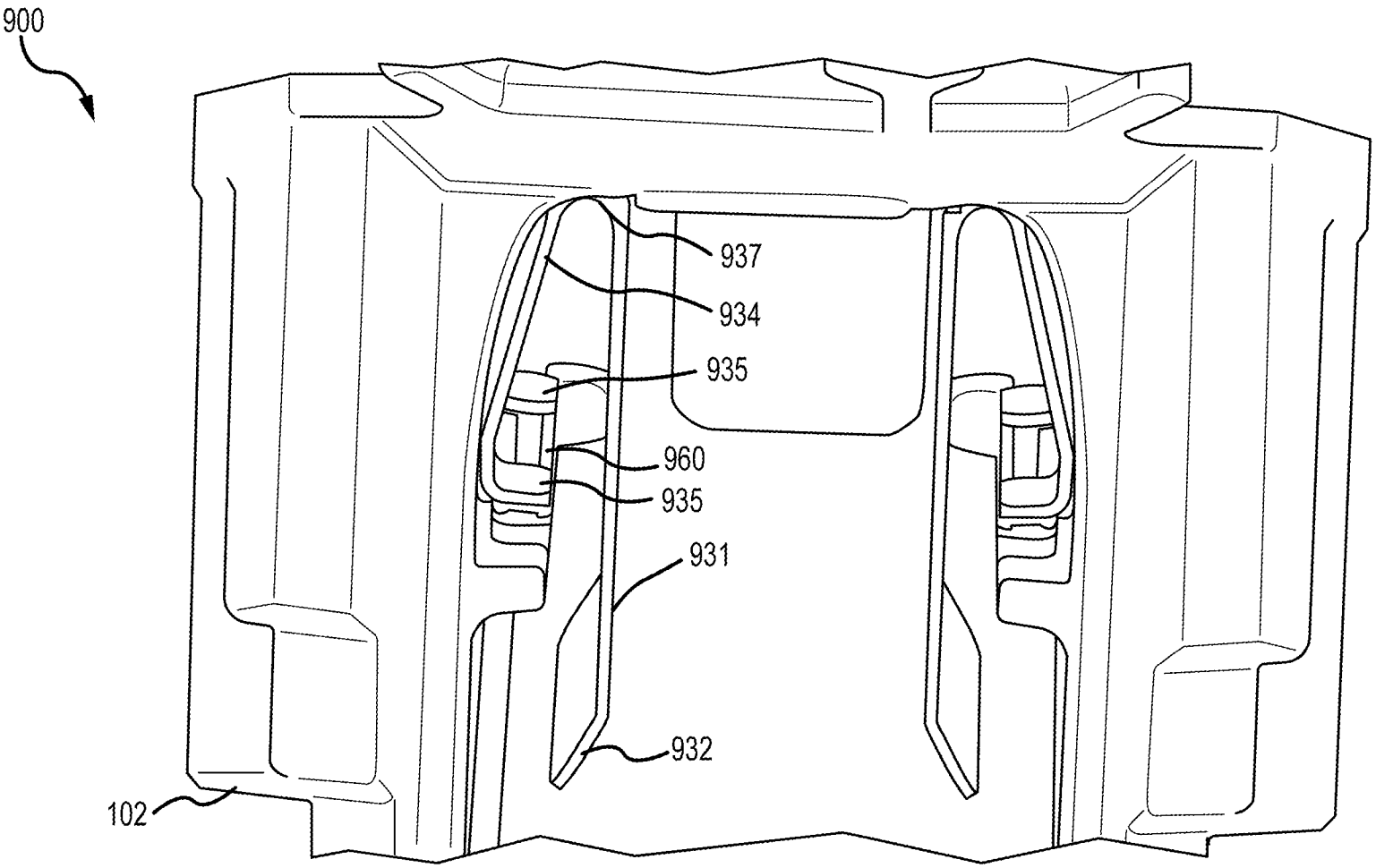
FIG. 11B illustrates one or more leaf springs mounted within an interior of a feed tower of an embodiment of the present disclosure.
Figure 11C:
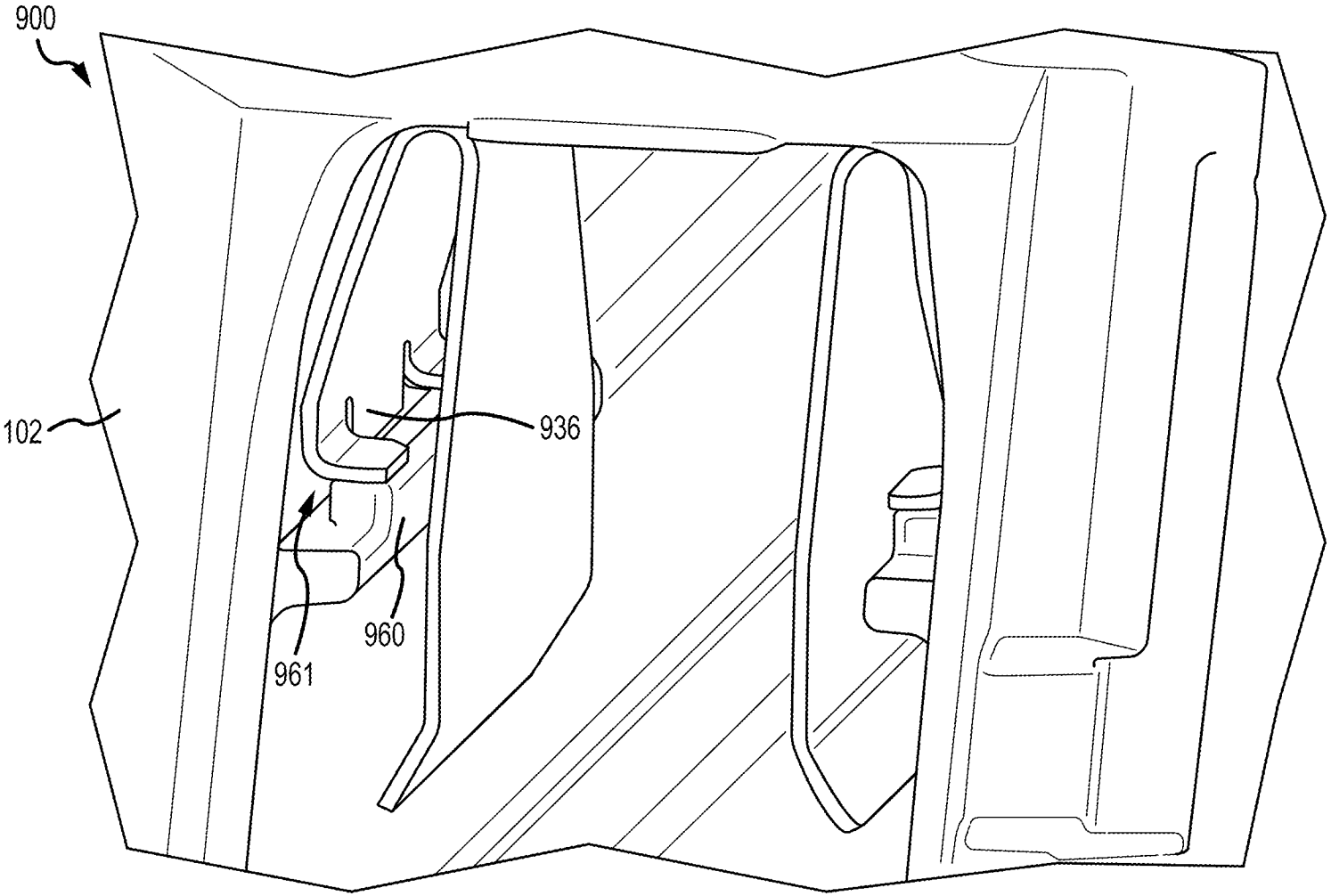
FIG. 11C illustrates a close-up view of one or more leaf springs mounted within an interior of a feed tower of an embodiment of the present disclosure.
Figure 11D:
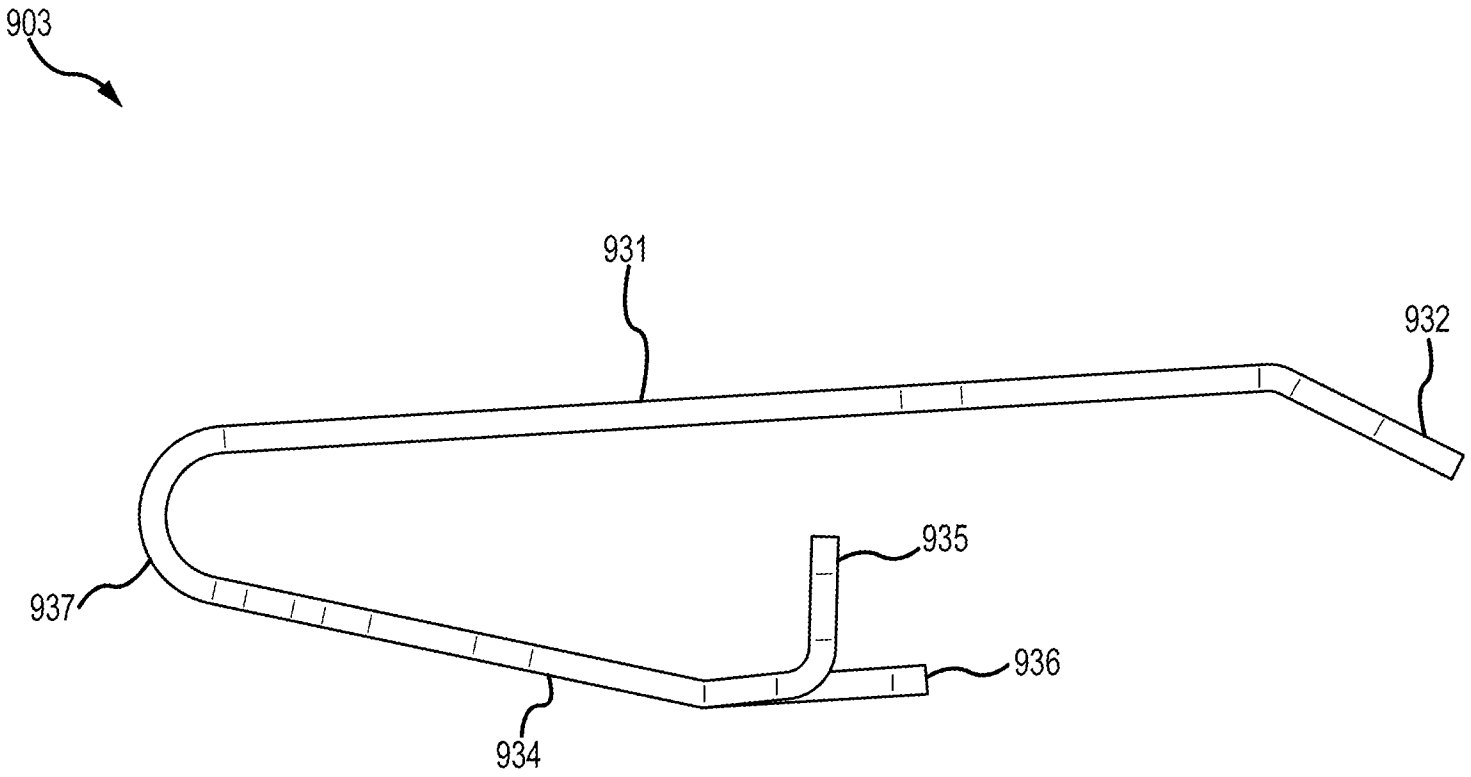
FIG. 11D illustrates a detailed view of a leaf spring of an embodiment of the present disclosure.

Turning now to FIGS. 11A and 11D, which illustrate detailed views of the leaf springs 903. As seen, each leaf spring 903 may comprise an inner edge 931 (i.e., adjacent the cartridge edges in the magazine), an outer edge 934, and a curved section 937. As seen, in some cases, one or more of the inner edge and the outer edge may comprise one or more ramped or angled surfaces. In some examples, the outer edge 934 may comprise a clip, the clip having one or more inward protrusions 935 facing towards the inner edge 931, and a planar surface 936. The planar surface may be substantially parallel to the inner edge 931 when the leaf spring 903 is in an unflexed position. Furthermore, the inner edge 931 may comprise an outward bend 932 (also referred to as ramped surface 932), the outward bend 932 or ramped surface directed away from a vertical axis (e.g., shown as vertical axis 922 in FIG. 9) passing through a center of the feed tower.

In some examples, the leaf springs 903 may be configured to flex, for instance, during downward movement (i.e., away from the barrel) of the round stack in the feed tower. In some weapon systems, such as the GLOCK pistol, the slide may comprise a ramped underlug. This ramped underlug may be located directly above the topmost cartridge in the feed tower and may force the cartridges back down into the magazine, for instance, when the weapon is cycled. In some embodiments, the inner edges 931 of the leaf springs 903 may be configured to flex outward as the cartridge stack is pushed downward into the magazine, allowing a bottom of the cartridge stack to spread out or expand and effectively give the cartridge stack more room to traverse downward without having to compress the magazine's primary spring (i.e., put pressure on rounds below the leaf springs, such as in a drum portion of the magazine).

FIGS. 1B and 11C illustrate the mounting of the leaf springs 903 within an interior of the feed tower 102. As seen, the feed tower 102 may comprise a rail section 960, where at least a portion of the rail section is separated from the body of the feed tower by a gap 961. In some embodiments, the planar surface 936 may be shaped and sized so that it can be inserted (or received) within the gap 961, while the inward protrusions 935 may rest or be supported over a horizontal section of the rail 960. Further, at least a portion of the curved section 937 may be in contact with an interior face or edge of the feed tower, which may also help securely mount the leaf springs to the inside of the feed tower. In some cases, the horizontal section of the rail 960 over which the inward protrusions 935 rest may comprise an anti-slip material (e.g., shown by the grip strip on rail 960 in FIG. 11B), which may prevent the leaf springs 903 from sliding within the feed tower 102 as the cartridge stack is pushed up or down.

Figure 12A:
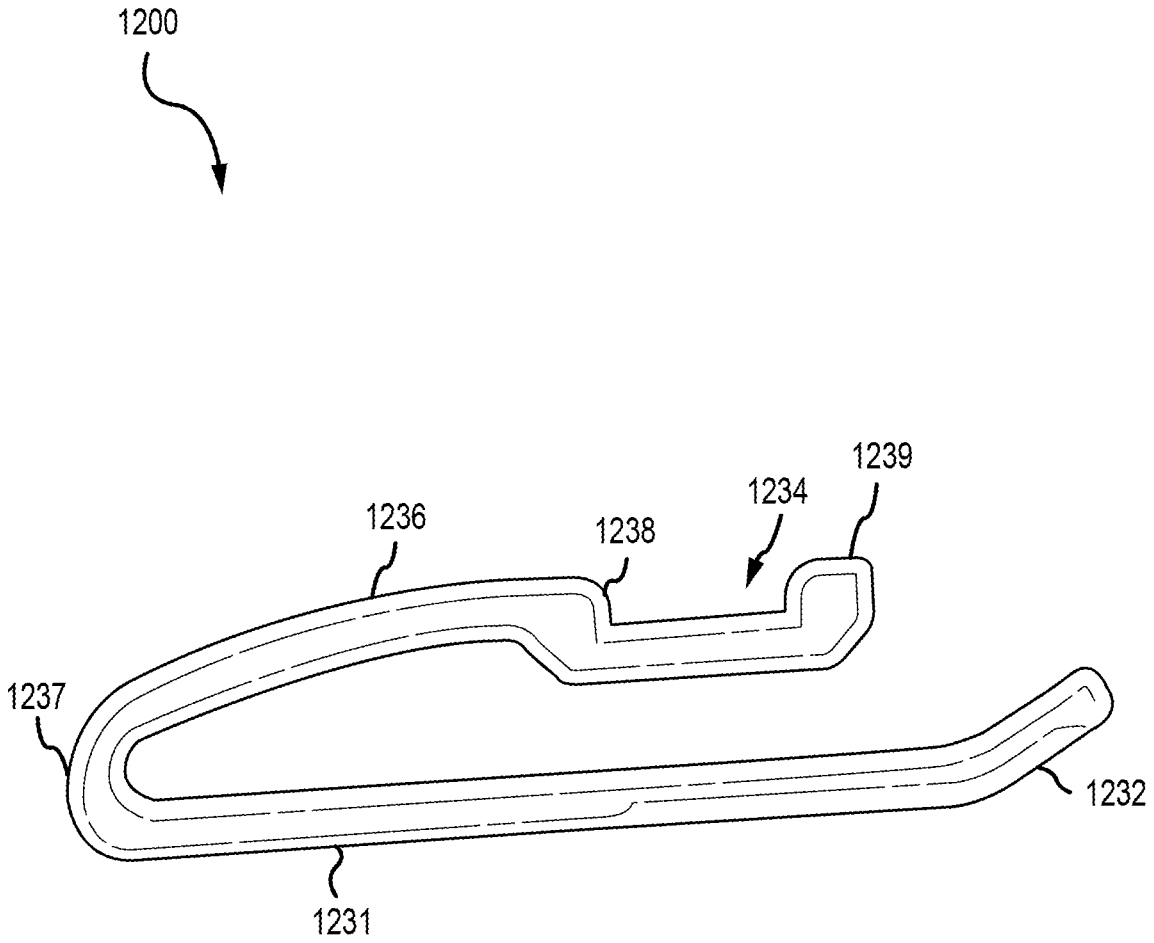
FIG. 12A illustrates a detailed view of a leaf spring of an alternative embodiment of the present disclosure.
Figure 12B:
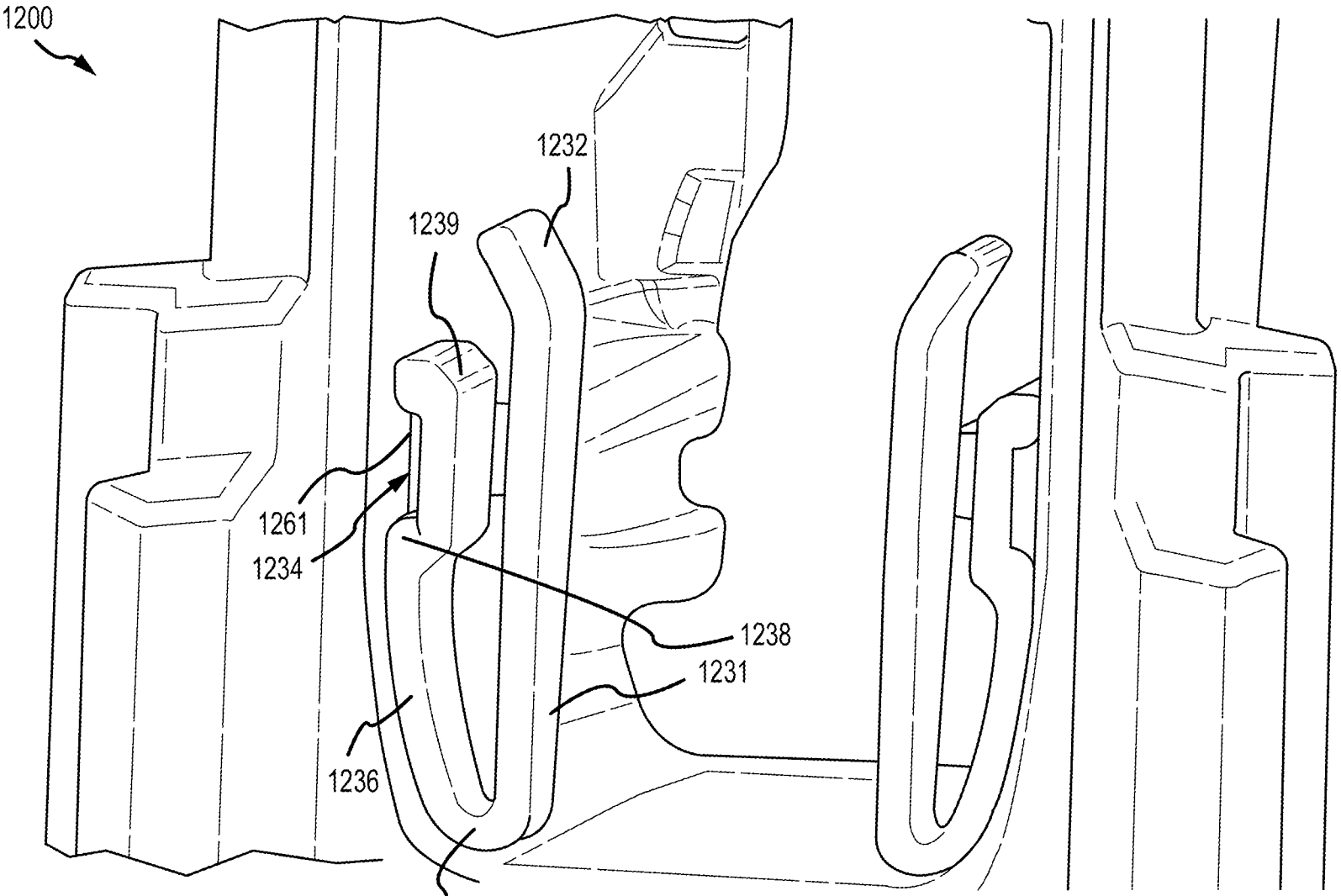
FIG. 12B illustrates a perspective view of one or more leaf springs of an alternative embodiment of the present disclosure.

FIGS. 12A and 12B illustrate another embodiment of a leaf spring 1200. The leaf spring 1200 may implement one or more aspects of the leaf spring 903, previously described in relation to FIGS. 9-11D. As seen, the leaf spring 1200 may comprise an inner edge 1231, a ramped surface 1232, a curved section 1237, an outer edge 1236, and a channel 1234 formed by vertical sections 1238 and 1239. In some cases, the channel 1234 may be shaped and sized such that it may be secured over a rail 1261 in an interior of the feed tower. For instance, FIG. 12B illustrates a pair of leaf springs 1200 nested opposite each other and mounted to an interior of the feed tower. In this case, the rail 1261 resembles an inward protrusion into the feed tower and comprises two horizontal sections extended inward into the feed tower, the two horizontal sections connected by a vertical section. As shown, the leaf springs 1200 may be clamped or clasped over the rail 1261 using one or more of the channel 1234, and the vertical sections 1238 and 1239. In some examples, one or more of the vertical sections 1238, 1239, and the outer edge 1236 of the leaf spring 1200 may be in contact with the interior of the feed tower.

Figure 13:
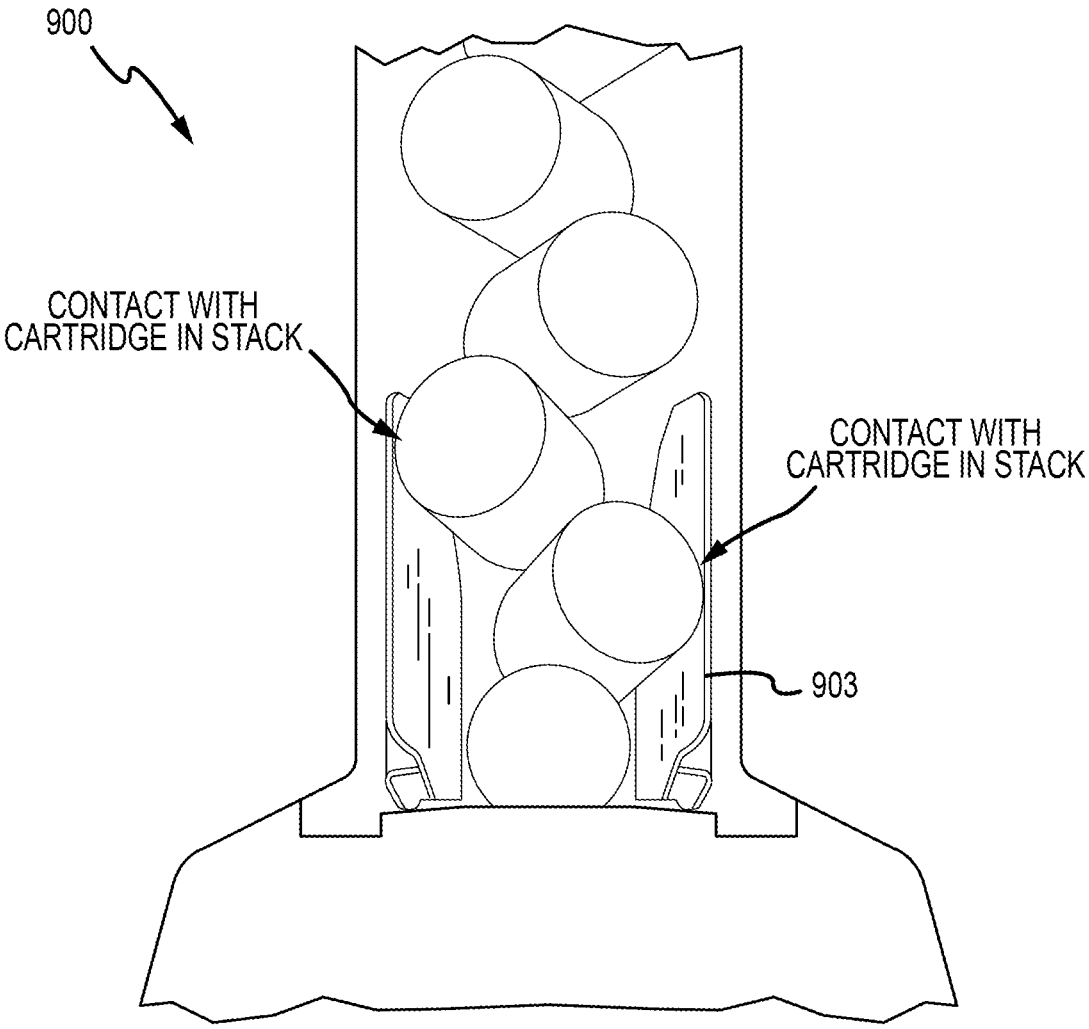
FIG. 13 illustrates a rear view of one or more leaf springs in a flexed position according to an embodiment of the present disclosure.
Figure 14:
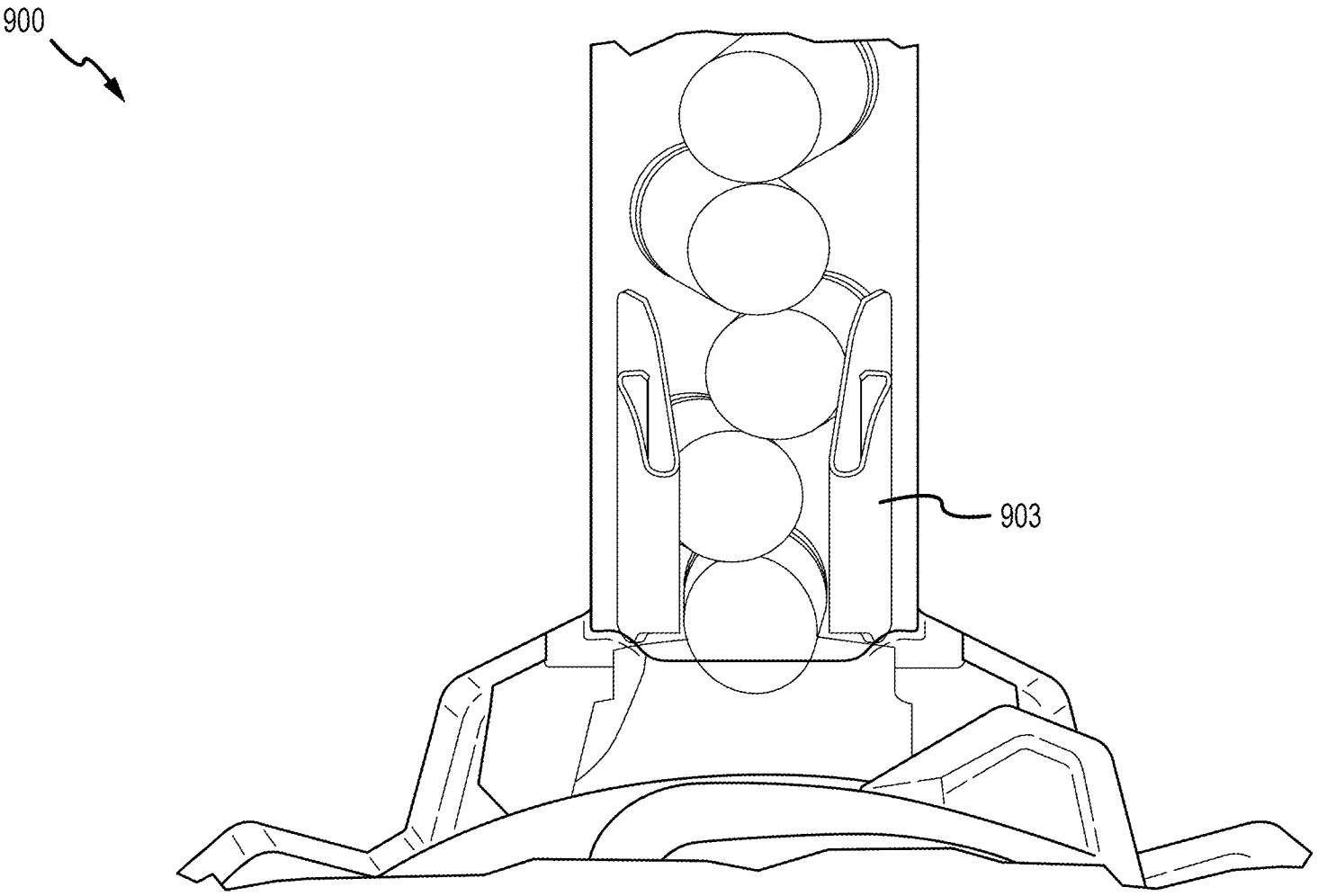
FIG. 14 illustrates a front view of one or more leaf springs in a flexed position according to an embodiment of the present disclosure.

FIGS. 13 and 14 illustrate leaf springs 903 in a flexed position, for instance, during downward movement of the cartridge stack in the feed tower. As seen, during downward movement, one or more cartridges in the stack may come into contact with the outward bends 932 of the leaf springs. The outward bends 932 may comprise a ramped surface angled away from a center of the feed tower. Such a design may facilitate the downward translation of the round stack by forcing the inner edge 931 (see FIG. 11B) away from the cartridges and allowing expansion room for a portion of the stack between the leaf springs. As seen, the inner edge 931 of a leaf spring 903 may be longer than its outer edge 934, which may serve to magnify the downward force applied to the cartridge stack when the weapon is cycled. For instance, the difference in length between the inner and outer edges may assist in preventing the flexed leaf springs 903 from unflexing by the upward force generated on the cartridge stack from the primary magazine spring or spring preload (e.g., torsional spring), for instance, in a drum body. In some aspects, the downward force required to push the cartridges down into the drum portion may be lower with the leaf springs of the present disclosure, as opposed to when such leaf springs are not present. After the weapon has been cycled, the leaf springs 903 may be configured to return to the unflexed configuration.

Figure 15:
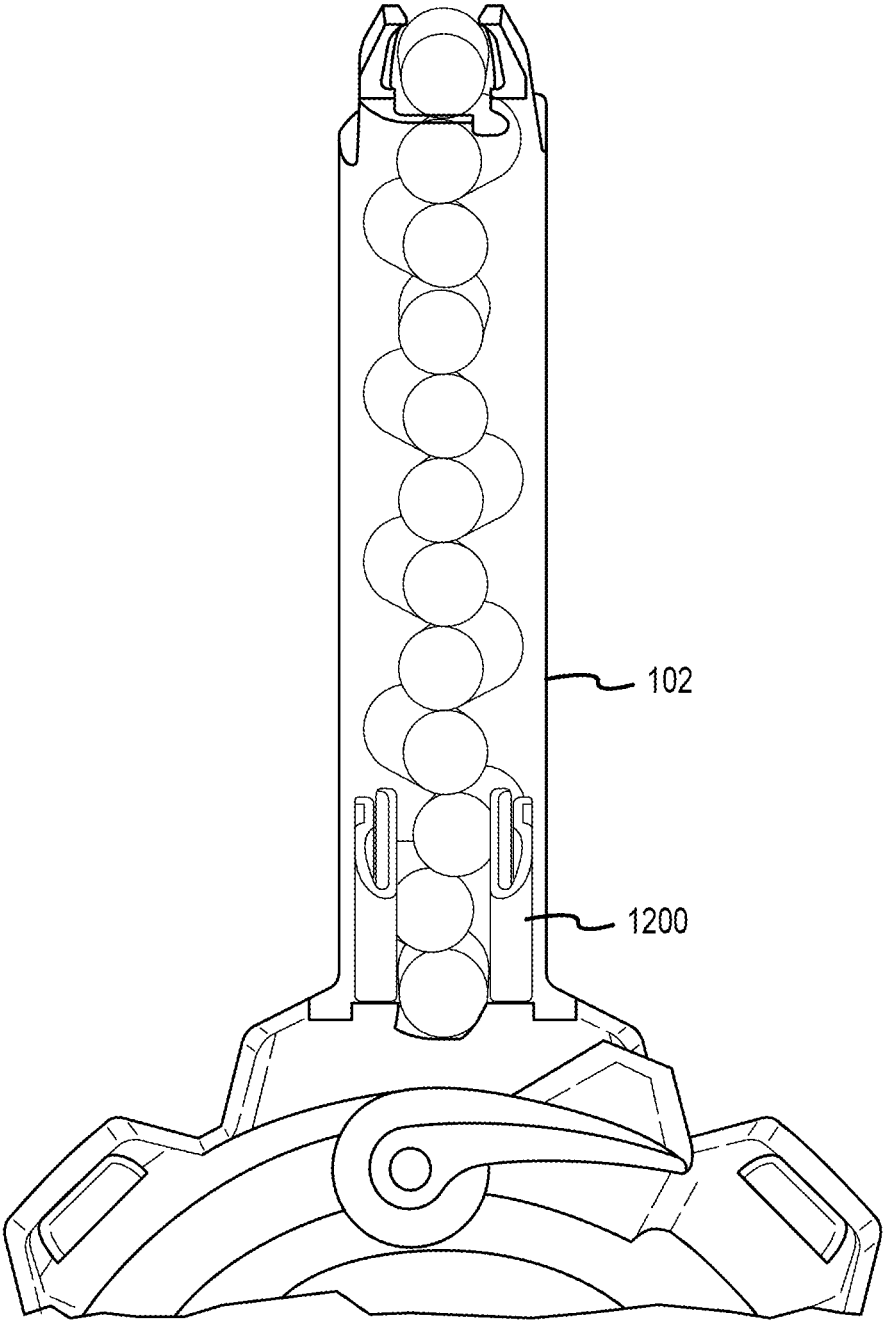
FIG. 15 illustrates a front view of one or more leaf springs in a flexed position within a feed tower according to an embodiment of the present disclosure.
Figure 16:
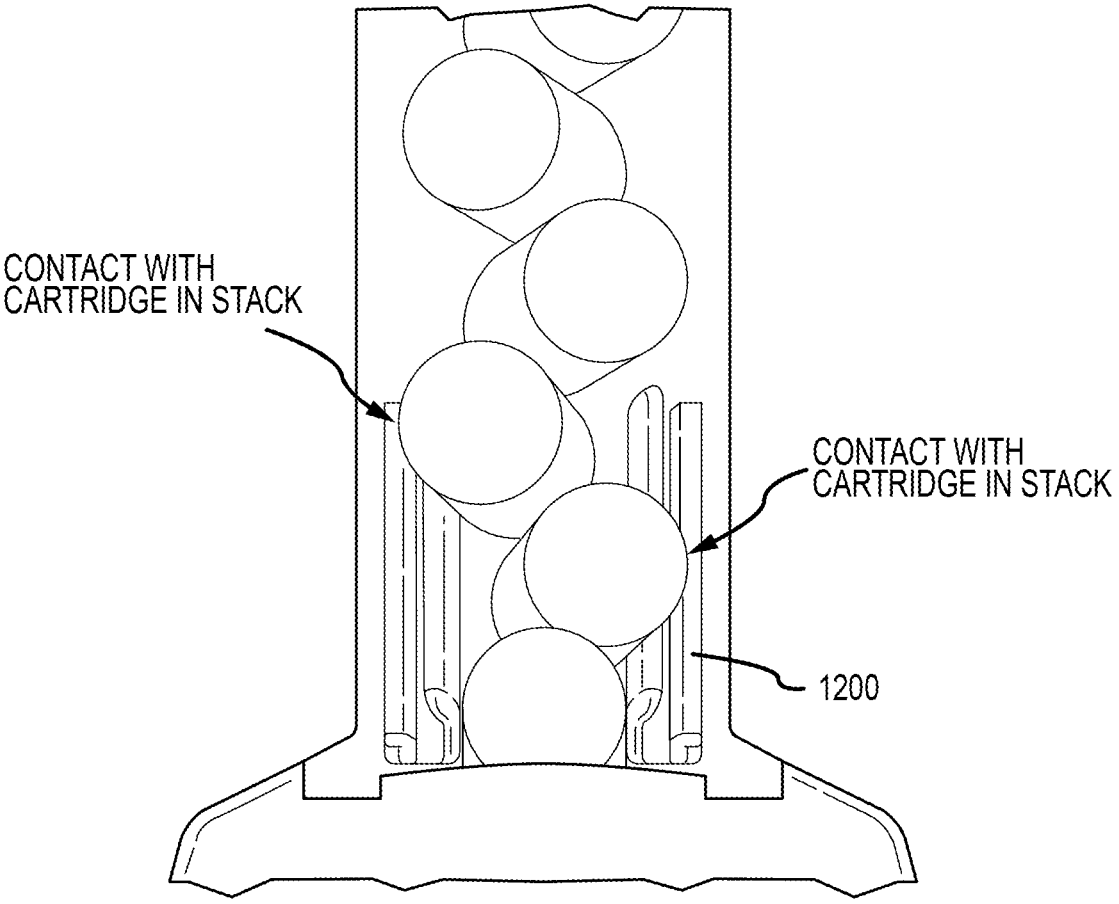
FIG. 16 illustrates a rear view of one or more leaf springs in a flexed position according to an alternative embodiment of the present disclosure.

FIGS. 15 and 16 illustrate leaf springs 1200 in a flexed position, for instance, during downward movement of the cartridge stack in the feed tower. In some examples, the leaf springs 1200 may be designed to operate in a similar manner as the leaf springs 903, previously described in relation to FIGS. 13 and 14. One can see that in the flexed position the round stack has greater room to expand between the leaf springs and this effectively allows downward movement of the stack when the magazine is loaded into a firearm in a bolt-closed state, while not putting undue pressure on rounds in the drum (below the leaf springs).

Figure 17:
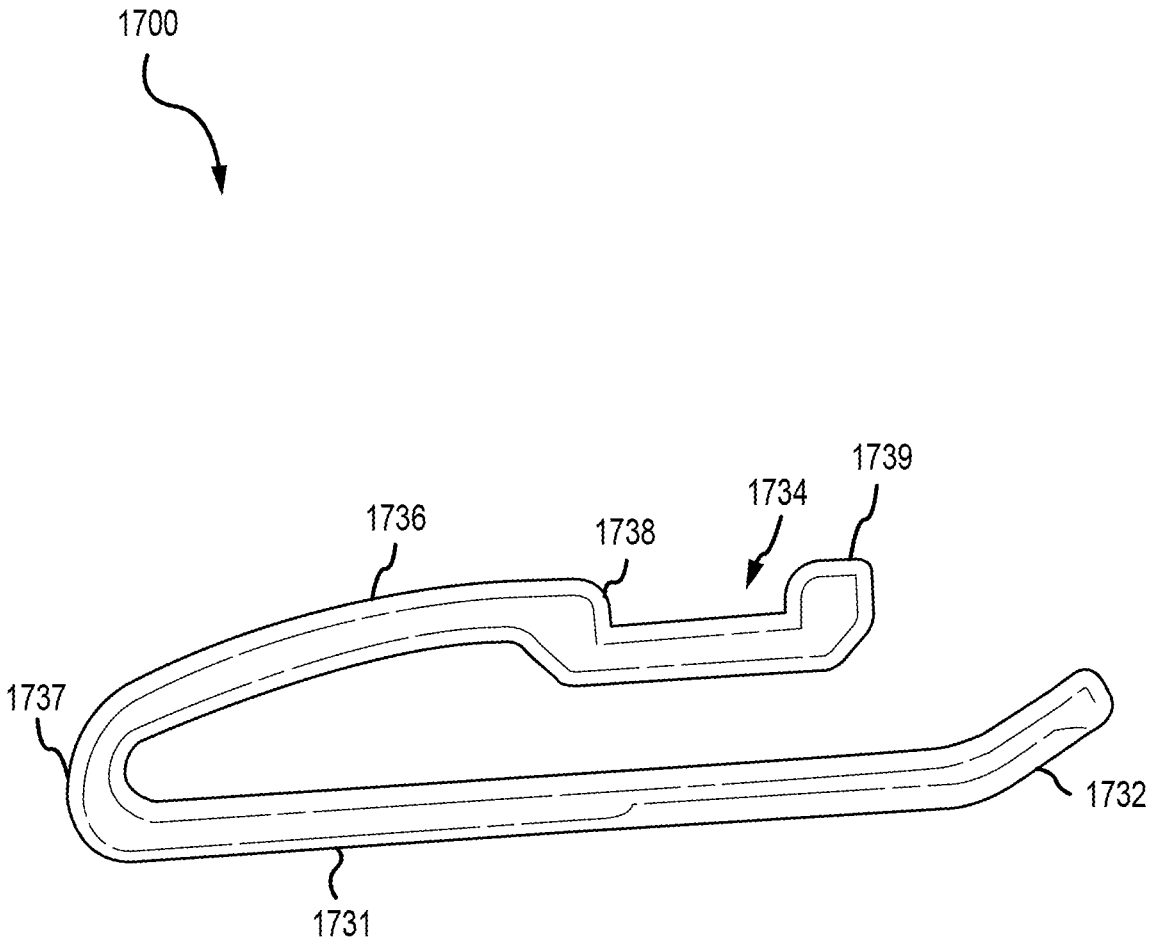
FIG. 17 illustrate a detailed view of a leaf spring of an alternative embodiment of the present disclosure.
Figure 18:
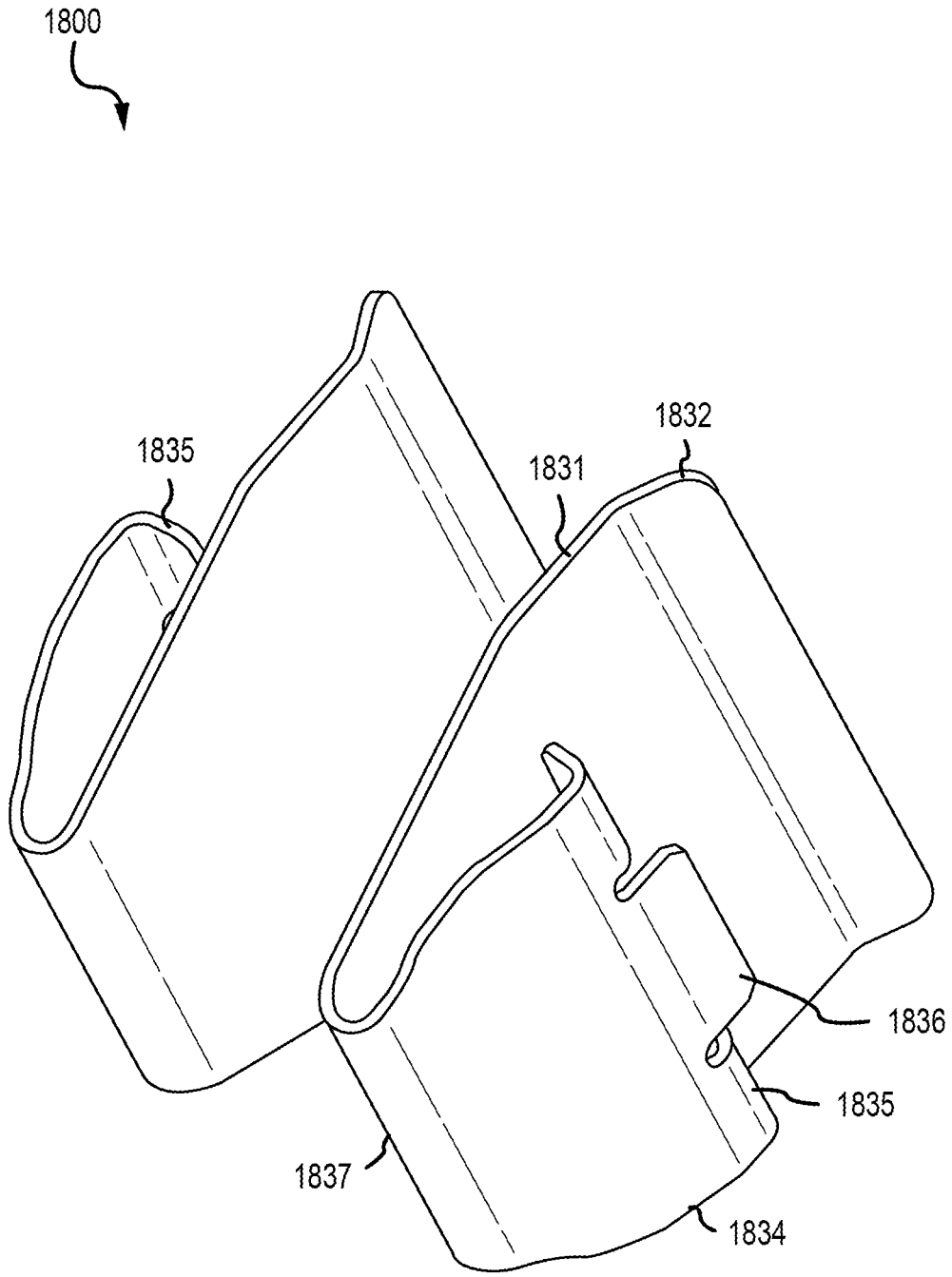
FIG. 18 illustrate a perspective view of one or more leaf springs of an alternative embodiment of the present disclosure.

FIGS. 17 and 18 illustrate leaf springs 1700 and 1800, respectively, according to an alternate embodiment of the disclosure. In these examples, the leaf springs 1700 and/or 1800 may be composed of a flexible plastic or another applicable polymer, as opposed to metal (e.g., stainless steel, steel alloy, etc.) seen in the previous designs. In some cases, the leaf springs 1700 and/or 1800 may implement one or more aspects of any of the other leaf springs or leaf spring systems described herein. For instance, leaf spring 1700 may be similar or substantially similar to the leaf spring 1200 previously described in relation to FIGS. 12A, 12B, 15, and/or 16, and may include one or more of an inner edge 1731, an outer edge 1736, a curved section 1737, one or more vertical sections 1738, 1739 on the outer edge 1736, a channel formed between the vertical sections 1738, 1739, and a ramped surface or outward bend 1732 on the inner edge 1731. In some cases, one or more of the vertical sections 1738, 1739, and the channel 1734 may be used to clip or mount the leaf spring 1700 to an interior of a feed tower, for instance, at the base of the feed tower.

FIG. 18 illustrates a pair of leaf springs 1800, which may be similar or substantially similar to the leaf spring(s) 903 previously described in relation to FIGS. 9-11D, 13, and/or 14. As shown, each leaf spring 1800 may comprise an inner edge 1831 (i.e., adjacent the cartridge edges in the magazine), an outer edge 1834, and a curved section 1837. As seen, in some cases, one or more of the inner edge and the outer edge may comprise one or more ramped or angled surfaces. In other cases, the inner edge and/or the outer edge may also comprise one or more irregular surfaces (e.g., dips, irregular slopes, etc.), for instance, as seen along the top surface of the outer edge 1834. In some examples, the outer edge 1834 may comprise a clip, the clip having one or more inward protrusions 1835 facing towards the inner edge 1831, and a planar surface 1836. The planar surface may be substantially parallel to the inner edge 931 when the leaf spring 1800 is an unflexed position. Furthermore, the inner edge 1831 may comprise an outward bend 1832 (also referred to as ramped surface 1832), the outward bend or ramped surface directed away from a vertical axis (e.g., shown as vertical axis 922 in FIG. 9) passing through a center of the feed tower. It should be noted that, the leaf springs 1700 and/or 1800 may be mounted in a similar manner to the leaf springs 903 and/or 1200, respectively, described in relation to the preceding figures. Additionally, or alternatively, the leaf springs 1700 and/or 1800 may operate in a similar manner to any of the leaf springs or leaf spring systems described herein.

Figure 5:
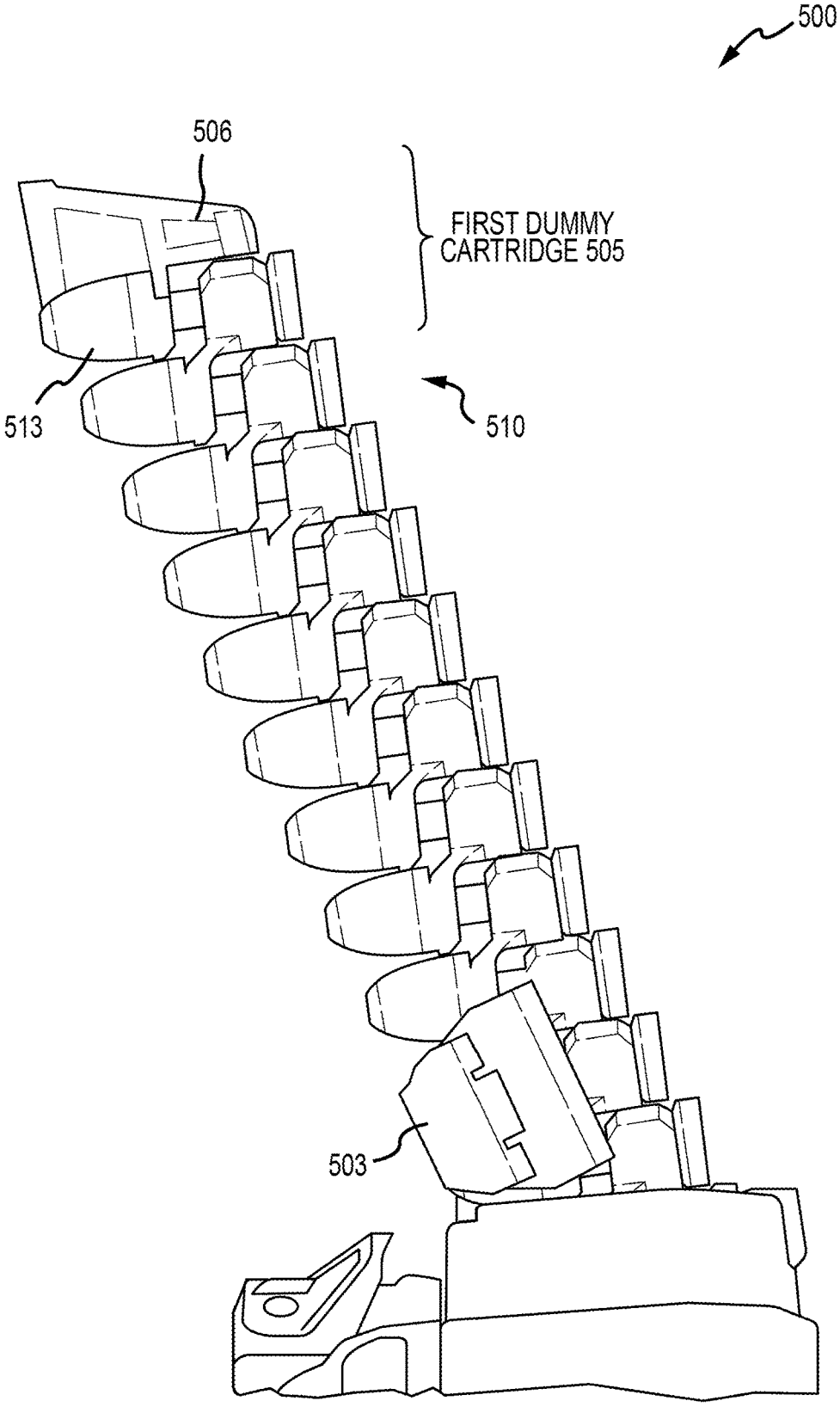
FIG. 5 illustrates a cartridge stack and follower assembly of an embodiment of the present disclosure.
Figure 6:
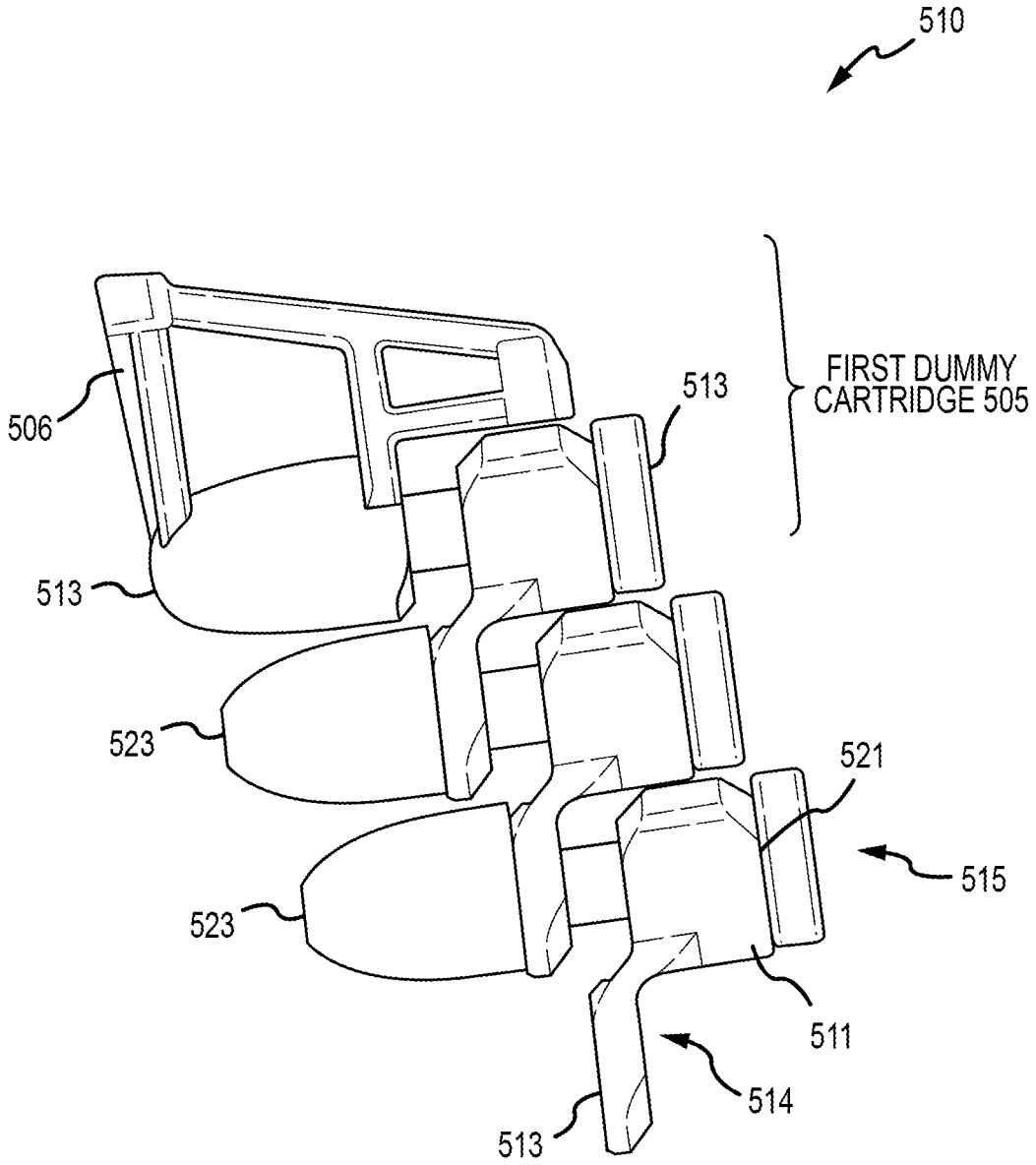
FIG. 6 illustrates a close-up view of a cartridge stack and follower assembly of an embodiment of the present disclosure.
Figure 7:
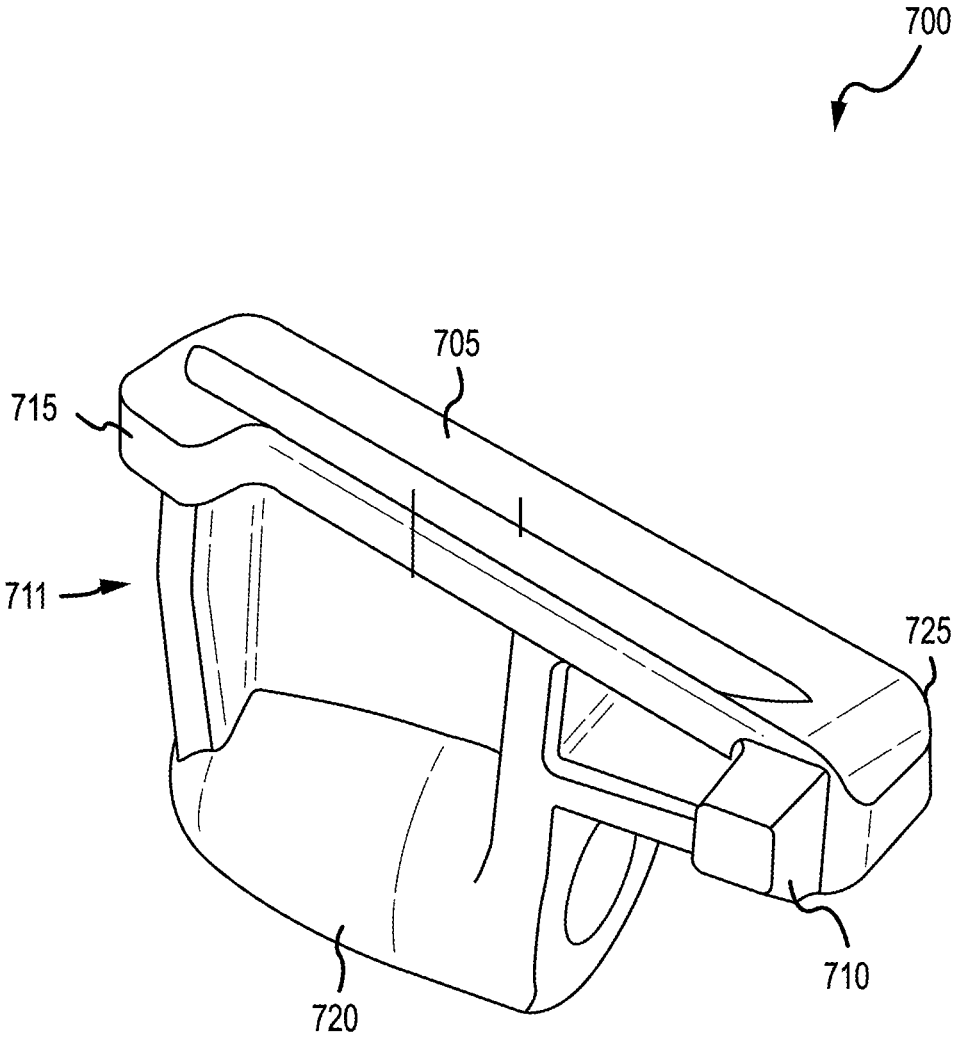
FIG. 7 illustrates a portion of a follower assembly of an embodiment of the present disclosure.

FIG. 5 illustrates an embodiment of the present disclosure that includes a first "dummy cartridge" 505 of a follower assembly 510. For ease of illustration, the feed tower has not been shown in this example. However, FIG. 5 depicts the leaf springs 503 that are configured to be mounted in the interior of the feed tower (e.g., using a leaf, such as leaf 933 in FIG. 9). The leaf spring(s) 503 may be similar or substantially similar to the leaf springs 103 or any of the other leaf springs described throughout this disclosure. As seen, the first dummy cartridge 505 of the follower assembly 510 may have a platform 506 configured to interface with a cartridge (not shown), which may be the last cartridge of a drum magazine. The platform 506 (also shown as platform 705 in FIG. 7) may be on a top-facing side of the first dummy cartridge 505 (also shown as first dummy cartridge 700 in FIG. 7) and may be configured to interface with a cartridge at an angle relative to a longitudinal axis of a feed tower of the magazine. This angle may include front to back slope as well as side to side slope. For instance, FIGS. 5 and 6 show more clearly the front to back slope, while FIG. 7 shows both the front to back slope, as well as the side-to-side slope. The front to back slope may bias the first dummy cartridge 505 towards a rear of the magazine when a force is applied (e.g., via a spring in the drum body) to the first dummy cartridge 505 that pushes or pulls it in an upward direction through the tower of the magazine. The side-to-side slope, in conjunction with a resistive force from the last cartridge, may bias the first dummy cartridge 505 toward one side (e.g., a left side) of the magazine. This bias (e.g., leftward bias) allows a protruding heel (e.g., shown as protruding heel 715 in FIG. 7) to engage a flange of a bolt lock-back mechanism, where such engagement might not occur without this leftward movement of the first dummy cartridge 505 (also shown as first dummy cartridge 700 in FIG. 7). The leftward movement can include either or both of rotational and translational movement. The bolt lock-back mechanism (often used in a rifle or carbine) referred to throughout this application has similar function and structure to a slide lock-back mechanism (often used in a pistol), and thus for purposes of this disclosure, a slide lock-back mechanism can be used anywhere that a bolt lock-back mechanism is referenced.

In some cases, the first dummy cartridge 700 may also have a stop 710 configured to interface with a surface near the feed end of the magazine. The stop 710 may have a substantially planar forward-facing surface and may protrude from one side (e.g., the left side) of the first dummy cartridge 700. The forward-facing surface may form an angle relative to the platform 705. The stop 710 may be configured to cause a front 711 of the first dummy cartridge 700 to kick up when the stop 710 interfaces with the surface near the feed end of the magazine. The stop 710 may interface with the surface near the feed end of the magazine when no cartridges remain in the magazine. In some embodiments, the front 711 of the forward-facing side of the first dummy cartridge 700 may also have a protruding heel 715 extending sideways from front 711 of the platform 705, which may enable the first dummy cartridge 700 to better interface with the slide lock-back interface or mechanism of some firearms, particularly when the stop 710 causes the front 711 of the forward-facing side of the first dummy cartridge 700 to kick up. In other embodiments, the stop 710 may protrude from a different side of the first dummy cartridge 700, such as the right side. In other embodiments, the stop 710 may have a non-planar forward-facing surface, such as a curved or irregular surface, configured to interface with a surface near the feed end of the magazine. In other embodiments, the stop 710 may be configured to cause the top of the forward-facing side of the first dummy cartridge 700 to kick down when the stop 710 interfaces with a surface near the feed end of the magazine. In other embodiments, the heel 715 may extend sideways from the top of the platform 705. The kicking up of the front 711 of the forward-facing side of the first dummy cartridge 700 caused by the stop 710, along with continued upward pressure on the first dummy cartridge, for instance, from a follower spring below, may assist in directing force from the protruding heel 715 into a bolt lock-back mechanism.

In some embodiments, the platform 705 may be configured to partially protrude from the feed end of the magazine when no cartridges remain in the magazine. The platform 705 may be substantially flat and planar, though angled; however, in other embodiments the platform 705 may have a curved or irregular surface (not shown) so as to provide an alternative interfacing with a cartridge. In other embodiments, the platform (e.g., platform 705 in FIG. 7, platform 506 in FIGS. 5 and 6) may be configured to bias the first dummy cartridge (e.g., first dummy cartridge 700, first dummy cartridge 505) in a different direction than that shown in FIGS. 5-7. In yet other cases, the platform may not bias the first dummy cartridge. However, the platform 506 or 705 biasing shown in FIGS. 5-7 may be preferable to better align with and engage a slide lock-back interface or mechanism in some handguns or other firearms.

The first dummy cartridge 700 can also include a bolt ramp 725 (also referred to as pistol slide ramp 725), which is angled relative to a direction of travel of the bolt or the pistol slide. In this way, when the bolt or pistol slide impinges on the first dummy cartridge 700, the bolt contacts this curved and/or angled bolt ramp 725 and causes a downward pressure on the first dummy cartridge 700 that pushes the follower stack down and out of the way of the bolt allowing the bolt to move forward across the platform 705 without jamming. As described above, some weapon systems, such as the GLOCK pistol system, feature a ramped underlug feature on the pistol slide. In some cases, the platform 705 and/or angled ramp 725 may be configured to interface with this ramped underlug feature on the pistol slide, which may facilitate in forcing the follower back down into the magazine when the weapon is cycled. Further, the combination of the platform 705, angled ramp 725, and/or the leaf springs (e.g., shown as leaf springs 503 in FIG. 5) may facilitate in translating the forward force from the pistol slide into sufficient downward force (i.e., to overcome the follower spring preload), thus allowing the follower to retract in the magazine. In some cases, the leaf springs may return to an unflexed position after the weapon has been cycled.

The first dummy cartridge 700 (also shown as first dummy cartridge 505 in FIG. 5) may also have a cartridge-shaped portion 720 (also shown as cartridge-shaped portion 520) configured to interface with the magazine in a similar fashion to an actual cartridge. The cartridge-shaped portion 720 may be of a similar shape to the actual cartridges used in the magazine and may be positioned on a bottom-facing side of the first dummy cartridge 700. The cartridge-shaped portion 720 may enable the first dummy cartridge 700 to interface with the mechanisms of the magazine, such as a cartridge alignment and/or a cartridge moving mechanism, which may allow the first dummy cartridge 700 to move through the magazine in a fashion similar to an actual cartridge. In other embodiments, the cartridge-shaped portion 720 may be positioned on the bottom-facing side or in the middle of the first dummy cartridge 700. In other embodiments, the first dummy cartridge 700 may not include a cartridge-shaped portion 720.

The first dummy cartridge 700 may be part of a follower assembly (e.g., shown as follower assembly 510 in FIGS. 5 and 6) in a variety of magazine types, such as box or drum magazines; however, the first dummy cartridge 700 may be configured, for example by its dimensions and shape, to traverse a non-linear track, such as the winding tracks often found in drum magazines, while producing minimal frictional forces and maintaining proper alignment so as to avoid causing blockages or jams (e.g., avoiding nose diving of cartridges). In one embodiment, a follower spring can be a torsional spring coupled to a rotatable arm and may be positioned inside the drum body (e.g., drum body 101 in FIG. 1).

FIG. 6 illustrates an embodiment of the present disclosure that includes a follower assembly 510 with a plurality of linked dummy cartridges 523 that are linked to a first dummy cartridge 505. Each of the linked dummy cartridges 523 may be of a similar shape to the actual cartridges or rounds used in the magazine enabling the linked dummy cartridges 523 to interface with the mechanisms of the magazine, such as the cartridge alignment and cartridge moving mechanisms, which may allow the linked dummy cartridges 523 to move through the magazine in a fashion similar to an actual cartridge. The linked dummy cartridges 523 and the first dummy cartridge 505 may be linked together using a series of links 511 and rollers 515. Each roller 515 can include a pin portion that passes through a corresponding link 511, and a head portion having a larger diameter than the pin portion and shaped to interface with and roll along inner sides of a magazine. Each roller 515 may pass through a first hole 521 in a link 511 and into a hole (not visible) in a linked dummy cartridge 523 or the first dummy cartridge 505, rotatably coupling the link 511 to the linked dummy cartridge 523 or the first dummy cartridge 505. Each link 511 may have a protruding portion 513 with a second hole 514 configured to allow a roller 515 of the following adjacent linked dummy cartridge 523 to pass through, rotatably coupling the link 511 of one linked dummy cartridge 523 to the following adjacent linked dummy cartridge 523. The second hole 514 of the last link 511 in the follower assembly 200 may have no roller 515. The second hole 514 of the link 511 of the preceding linked dummy cartridge 523, or first dummy cartridge 505, may be positioned below the first hole 521 of the link 511 of the current linked dummy cartridge 523; however, in other embodiments, the second hole 514 of the link 511 of the preceding linked dummy cartridge 523, or first dummy cartridge 505, may be positioned above the first hole 521 of the link 511 of the current linked dummy cartridge 523. The resulting chain of linked dummy cartridges 523 and first dummy cartridge 505 allows each adjacent pair of linked dummy cartridges 523, or first dummy cartridge 505 and the adjacent linked dummy cartridge 523, to rotatably move about each other. As a consequence, the follower assembly 510 may have a high degree of flexibility enabling it to traverse non-linear tracks within a magazine, such as the winding tracks of a drum magazine. Each linked dummy cartridge 523, link 511, and roller 515 may combine to form a roughly cartridge-like shape enabling the follower assembly 510 to interface with the mechanisms of the magazine, such as the cartridge alignment and cartridge moving mechanisms, which may allow the follower assembly 510 to move through the magazine in a fashion similar to an actual stack of cartridges.

In some examples, the follower assembly 510 may interface with a mechanism for moving cartridges within the drum magazine body (e.g., drum body 101 in FIG. 1), such as a follower spring. In one embodiment, the follower spring can be a torsional spring coupled to a rotatable arm. The cartridge-like size and shape of the linked dummy cartridges may enable the follower assembly 510 to mimic a cartridge stack and traverse a spiral track (not shown) within the drum body while producing minimal frictional forces and maintaining proper alignment so as to avoid causing blockages or jams. When no cartridges remain in the magazine, the follower assembly 510 may extend beyond the end or top of the feed tower (e.g., feed tower 102 in FIG. 1) to align with and engage a bolt lock-back mechanism. A stop on the follower assembly 510 may interface with a surface near the top of the feed tower of the magazine causing a front of the first dummy cartridge of the follower assembly 510 to kick up and extend even further beyond the end or top of the feed tower of the magazine and assist in interfacing with and directing force into the slide lock-back interface or mechanism of the firearm. The stop can be arranged toward a rear of the first dummy cartridge from a center of gravity thereof.

The previous description of the disclosed embodiments is provided to enable any person skilled in the art to make or use the presently disclosed embodiments. Various modifications to these embodiments will be readily apparent to those skilled in the art, and the generic principles defined herein may be applied to other embodiments without departing from the spirit or scope of the presently disclosed embodiments. Thus, the presently disclosed embodiments are not intended to be limited to the embodiments shown herein but is to be accorded the widest scope consistent with the principles and novel features disclosed herein.

What is claimed is:

1. A firearm magazine, comprising:
a body;
a feed tower;
wherein the feed tower is configured to house one or more cartridges and comprises:
a feed end opposite a base end,
and
one or more leaf springs positioned within the feed tower, wherein the one or more leaf springs are positioned closer to the base end than to the feed end, and wherein the one or more leaf springs are configured to bias the one or more cartridges through the feed tower towards the feed end or the base end of the feed tower; and
the body is coupled directly to the base end of the feed tower and is configured to receive the one or more cartridges from the one or more leaf springs.

2. The firearm magazine of claim 1, wherein:
the one or more leaf springs are further configured to be in a flexed position or an unflexed position;
wherein downward movement of the one or more cartridges in the feed tower flex the one or more leaf springs into the flexed position via outwardly flexing the one or more leaf springs, and
in the unflexed position, inner edges of the one or more leaf springs are parallel or substantially parallel to edges of the one or more cartridges in the feed tower.

3. The firearm magazine of claim 2, wherein:
the one or more leaf springs comprises:
the inner edge,
a hairpin section, and
a clip;
wherein the hairpin section comprises a protrusion that is configured to be parallel or substantially parallel to the inner edge when the one or more leaf springs are in the unflexed position; and
the one or more leaf springs are further configured to mount to an interior of the feed tower using the clip.

4. The firearm magazine of claim 3, wherein:
the clip of the one or more leaf springs further comprises an opening, wherein
the opening in the clip is shaped and sized to receive or clamp over a rail in the interior of the feed tower.

5. The firearm magazine of claim 4, wherein:
the feed tower further comprises a gap positioned between the rail and an inner surface of the feed tower;
wherein at least a portion of a channel is received within the gap, while another surface of the channel is pushed against a face of the rail.

6. The firearm magazine of claim 2, wherein:
the inner edges of the one or more leaf springs are separated from the body of the feed tower by a gap; and
the gap is configured to permit outward movement of the one or more leaf springs when the one or more cartridges is pressed into the firearm magazine.

7. The firearm magazine of claim 2, wherein:
the one or more leaf springs further comprises:
the inner edge,
an outer edge, and
a curved section;
wherein one or more of the inner edge and the outer edge comprises one or more ramped or angled surfaces;
the outer edge further comprises a clip comprising one or more inward protrusions positioned to face the inner edge, and a planar surface;
the planar surface is substantially parallel to the inner edge when the one or more leaf springs are in the unflexed position; and
the inner edge further comprises an outward bend or ramped surface, wherein the outward bend or ramped surface is positioned to direct away from a vertical axis passing through a center of the feed tower.

8. The firearm magazine of claim 1, wherein:
a feed end of the firearm magazine is configured to operate with an underlug of a slide of a firearm such that when the slide closes and the underlug presses upon a first cartridge in a round stack, or a first dummy cartridge of a follower assembly, in the feed tower, a width of the round stack between the one or more leaf springs expands.

9. The firearm magazine of claim 1, wherein given a closed-bolt firearm, the flexing of the one or more leaf springs allows downward movement of the round stack without applying undue pressure on rounds below the one or more leaf springs.

10. A leaf spring system comprising:

one or more leaf springs comprising:

an inner edge comprising a ramped surface, an outer edge, and a channel formed on the outer edge by vertical sections and shaped and sized to be secured over a rail in an interior of a feed tower;

wherein one or more of the vertical sections and the outer edge are in contact with the interior surface of the feed tower;

wherein a curved section is positioned between the inner edge and the outer edge and forms a C-shaped curve in the one or more leaf springs; and wherein the one or more leaf springs are positioned closer to a base end of the feed tower than to a feed end of the feed tower, wherein the base end is opposite the feed end, and wherein the base end is directly coupled to a body of a firearm magazine.

11. The leaf spring system of claim 10, wherein:

the one or more leaf springs comprise a first leaf spring and a second leaf spring; and the first leaf spring and the second leaf spring are nested opposite each other on a right side and a left side of cartridges in a round stack in the feed tower.

12. The leaf spring system of claim 11, wherein:

the one or more leaf springs are further configured to be in a flexed position or an unflexed position;

wherein downward pressure on the round stack outwardly flexes the one or more leaf springs in the flexed position and widens the round stack between the one or more leaf springs and thus downward translation of at least some of the one or more cartridges, and in the unflexed position, the inner edge of the one or more leaf springs is parallel or substantially parallel to a portion of the round stack adjacent to the one or more leaf springs.

13. The leaf spring system of claim 12, wherein:

the one or more leaf springs further comprise:

a hairpin section, and a clip;

wherein the hairpin section comprises a protrusion that is configured to be parallel or substantially parallel to the inner edge when the one or more leaf springs are in the unflexed position; and the one or more leaf springs are further configured to mount to the interior surface of the feed tower using the clip.

14. The leaf spring system of claim 13, wherein:

the clip of the one or more leaf springs further comprises an opening, wherein the opening in the clip is be shaped and sized to receive or clamp over the rail in the interior of the feed tower.

15. The leaf spring system of claim 14, wherein:

the feed tower further comprises a gap positioned between the rail and an inner surface of the feed tower;

wherein at least a portion of the channel is received within the gap, while another surface of the channel is pushed against a face of the rail.

16. The leaf spring system of claim 12, wherein:

the inner edge of the one or more leaf springs is separated from the body of the feed tower by a gap; and the gap configured to permit outward movement of the one or more leaf springs when the one or more cartridges is pressed into the firearm magazine.

17. The leaf spring system of claim 12, wherein:

in the unflexed position, the one or more leaf springs are substantially parallel to a vertical axis through the feed tower and the one or more cartridges in the feed tower.

18. A firearm magazine, comprising:

a feed tower;

wherein the feed tower is configured to house one or more cartridges and comprises:

a feed end opposite a base end, and one or more leaf springs; and the one or more leaf springs positioned within the feed tower and near the base end and configured to bias the one or more cartridges through the feed tower towards the feed end or the base end of the feed tower depending on a location of each cartridge, wherein a body is coupled directly to the base end.

19. The firearm magazine of claim 18, further comprising one or more dummy cartridges.

20. The firearm magazine of claim 19, further comprising a drum coupled to the base end of the feed tower.

21. The firearm magazine of claim 19, wherein flexing of the one or more leaf springs outward allows ones of the one or more cartridges between the one or more leaf springs are able to angle outward or spread out allowing ones of the one or more cartridges at the feed end to traverse toward the base end.

22. A firearm magazine, comprising:

a body;

a feed tower;

wherein the feed tower is configured to house one or more cartridges and comprises:

a feed end, a base end, and two or more leaf springs positioned within the feed tower and configured to bias the one or more cartridges through the feed tower towards the feed end or the base end of the feed tower, wherein the two or more leaf springs are nested opposite each other on a right side and a left side of the one or more cartridges in the feed tower; and the body is coupled to the base end of the feed tower and is configured to receive the one or more cartridges from the two or more leaf springs.

23. The firearm magazine of claim 22, wherein:

the two or more leaf springs are further configured to be in a flexed position or an unflexed position;

wherein downward movement of the one or more cartridges in the feed tower flex the two or more leaf springs into the flexed position via outwardly flexing the two or more leaf springs, and in the unflexed position, inner edges of the two or more leaf springs are parallel or substantially parallel to edges of the one or more cartridges in the feed tower.

24. The firearm magazine of claim 23, wherein:

the two or more leaf springs comprises:

the inner edge, a hairpin section, and a clip;

wherein the hairpin section comprises a protrusion that is configured to be parallel or substantially parallel to the inner edge when the two or more leaf springs are in the unflexed position; and the two or more leaf springs are further configured to mount to an interior of the feed tower using the clip.

25. The firearm magazine of claim 24, wherein:

the clip of the two or more leaf springs further comprises an opening, wherein the opening in the clip is shaped and sized to receive or clamp over a rail in the interior of the feed tower.

26. The firearm magazine of claim 25, wherein:

the feed tower further comprises a gap positioned between the rail and an inner surface of the feed tower;

wherein at least a portion of a channel is received within the gap, while another surface of the channel is pushed against a face of the rail.

27. The firearm magazine of claim 23, wherein:

the inner edges of the two or more leaf springs are separated from the body of the feed tower by a gap; and the gap is configured to permit outward movement of the two or more leaf springs when the one or more cartridges is pressed into the firearm magazine.

28. The firearm magazine of claim 23, wherein:

the two or more leaf springs further comprises:

the inner edge, an outer edge, and a curved section;

wherein one or more of the inner edge and the outer edge comprises one or more ramped or angled surfaces;

the outer edge further comprises a clip comprising one or more inward protrusions positioned to face the inner edge, and a planar surface;

the planar surface is substantially parallel to the inner edge when the two or more leaf springs are in the unflexed position; and the inner edge further comprises an outward bend or ramped surface, wherein the outward bend or ramped surface is positioned to direct away from a vertical axis passing through a center of the feed tower.

29. The firearm magazine of claim 22, wherein:

a feed end of the firearm magazine is configured to operate with an underlug of a slide of a firearm such that when the slide closes and the underlug presses upon a first cartridge in a round stack, or a first dummy cartridge of a follower assembly, in the feed tower, a width of the round stack between the two or more leaf springs expands.

30. The firearm magazine of claim 22, wherein given a closed-bolt firearm, the flexing of the two or more leaf springs allows downward movement of the round stack without applying undue pressure on rounds below the two or more leaf springs.

* * * * *